US009037019B2

(12) United States Patent
Fujihara

(10) Patent No.: US 9,037,019 B2
(45) Date of Patent: May 19, 2015

(54) DEVELOPING DEVICE, IMAGE FORMING APPARATUS, AND METHOD FOR CONTROLLING DEVELOPING DEVICE

(71) Applicant: KYOCERA DOCUMENT SOLUTIONS INC., Osaka (JP)

(72) Inventor: Kensuke Fujihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 133 days.

(21) Appl. No.: 13/852,495

(22) Filed: Mar. 28, 2013

(65) Prior Publication Data

US 2013/0259504 A1 Oct. 3, 2013

(30) Foreign Application Priority Data

Mar. 30, 2012 (JP) ..... 2012-081621

(51) Int. Cl.
*G03G 15/06* (2006.01)
*G03G 15/09* (2006.01)

(52) U.S. Cl.
CPC ..... *G03G 15/065* (2013.01); *G03G 15/0907* (2013.01)

(58) Field of Classification Search
CPC ..... G03G 15/065; G03G 15/0907
USPC ..... 399/55, 270, 272, 273
See application file for complete search history.

(56) References Cited

U.S. PATENT DOCUMENTS

| | | | | |
|---|---|---|---|---|
| 2004/0005160 | A1 | 1/2004 | Kawamura et al. | |
| 2010/0129102 | A1* | 5/2010 | Fujihara et al. | 399/55 |
| 2013/0183053 | A1* | 7/2013 | Nakagawa et al. | 399/55 |
| 2014/0086606 | A1* | 3/2014 | Sakurabayashi | 399/55 |

FOREIGN PATENT DOCUMENTS

| | | |
|---|---|---|
| JP | 2004-4732 A | 1/2004 |

* cited by examiner

*Primary Examiner* — Sophia S Chen
(74) *Attorney, Agent, or Firm* — NDQ&M Watchstone LLP

(57) ABSTRACT

A developing device includes a developing roller, a magnetic roller, a capacitor, a transformer, and a control signal generating unit. The developing roller carries toner. The magnetic roller performs supply of toner to the developing roller and removal of toner from the developing roller. The transformer includes a primary side to which a capacitor is connected and a secondary side from which an AC voltage is output and applied to the developing roller. The control signal generating unit inputs a control signal to the capacitor and adjusts a DC bias value of the control signal so that a DC component of the control signal is the same before and after the change of the duty ratio of the control signal.

15 Claims, 11 Drawing Sheets

DEVELOPING DEVICE, IMAGE FORMING APPARATUS, AND METHOD FOR CONTROLLING DEVELOPING DEVICE

CROSS-REFERENCE TO RELATED APPLICATIONS

This application is based upon and claims the benefit of priority from the corresponding Japanese Patent Application No. 2012-081621 filed on Mar. 30, 2012, the entire contents of which are incorporated herein by reference.

BACKGROUND

The present disclosure relates to a developing device for developing an electrostatic latent image by using toner, an image forming apparatus including the developing device, and a method for controlling the developing device.

There is an image forming apparatus such as a multifunction peripheral, a copier, a printer, or a facsimile, which forms an electrostatic latent image on a photosensitive drum and develops the electrostatic latent image by toner so as to perform printing. Further, the image forming apparatus which uses toner for printing is equipped with a developing roller that carries toner. Further, an AC voltage is applied to the developing roller. Thus, the toner is scattered from the developing roller toward the photosensitive drum. Then, the electrostatic latent image is developed. Further, a duty ratio of the AC voltage applied to the developing roller may be changed in the case of necessity.

There is known the following image forming apparatus, which changes the duty ratio of the AC voltage applied to the developing roller. Specifically, there is known an image forming apparatus including an image carrying member, a charging member for charging the image carrying member, a developing means including a developer carrying member for carrying developer, so as to develop an electrostatic latent image farmed on the image carrying member by the developer, and a bias applying means for applying a bias to the developer carrying member. When the electrostatic latent image is developed, the bias applying means applies an AC bias so that the developing means can collect the developer from the image carrying member. As to a duty ratio of the AC bias applied to the developer carrying member by the bias applying means when the developer is collected, a ratio of potential for moving the developer from the developer carrying member to the image carrying member is larger than that when the electrostatic latest image is developed.

In order to scatter the toner, a periodically changing AC voltage is applied to the developing roller. A peak-to-peak voltage of the AC voltage may be approximately 1 to 2 kV. Further, in order to generate the AC voltage having a peak-to-peak voltage of one to a few kilovolts, a transformer is used in many cases. First, a control signal (for example, a clock signal) is generated, in which a high potential state and a low potential state are periodically repeated. Next, the control signal from which a DC component is removed by a capacitor is supplied to a primary side of the transformer. Then, a stepped-up AC voltage from a secondary aide of the transformer is applied to the developing roller.

Here, in view of preventing a leakage between the photosensitive drum and the developing roller (preventing a discharge) or preventing unevenness of a toner image, there is a case where a duty ratio of the AC voltage applied to the developing roller should be changed in accordance with the state. In this case, when a duty ratio of the control signal is changed, the duty ratio of the AC voltage applied to the developing roller is changed.

However, it is known that when the duty ratio of the control signal is changed, a large current is apt to flow in a circuit or an element such as the transformer or the capacitor of the developing device. In particular, when a larger transient change of the duty ratio occurs, a large current exceeding a rated current flows more easily in the developing device. Further, when a large current flows, the circuit in the developing device may be broken down. It is considered that one of the causes of such large current due to the change of the duty ratio is bias magnetism or magnetic saturation of the transformer, which is generated when an imbalanced voltage (with biased energy) is applied to the primary side of the transformer. When the bias magnetism is generated so that a magnetic flux is biased, there is a state as if the transformer is biased by a DC voltage. Further, when the magnetic saturation is generated by the bias magnetism in the transformer, the inductance of the transformer becomes very small. Therefore, it is necessary to prevent the magnetic saturation from being generated in the transformer so that a large current does not flow in the developing device.

Note that the above-mentioned known image forming apparatus changes the duty ratio. However, there is no consideration about the magnetic saturation generated when the duty ratio is changed. Therefore, the problem caused by changing the duty ratio of the control signal cannot be solved. In addition, because the above-mentioned known image forming apparatus applies a developing bias to the developer carrying member, it is necessary to prepare a plurality of types of power supplies. However, with this structure, it is necessary to prepare a plurality of systems (step-up circuits including the transformer and the like) for applying high voltages to a developing roller 21 for individual patterns of the developing bias applied to the developing roller 21. Therefore, the conventional image forming apparatus has a problem that a high voltage generating circuit becomes a large scale and that manufacturing cost is increased.

SUMMARY

In view of the above-mentioned problem, it is an object of the present disclosure to prevent magnetic saturation from being generated in the transformer due to a change of the duty ratio of the control signal and to prevent a circuit in the developing device from being broken down when a large current flows.

In order to solve the above-mentioned problem, a developing device according to a first aspect of the present disclosure includes a developing roller, a magnetic roller, a capacitor, a transformer, and a control signal generating unit. The developing roller is opposed to the photosensitive drum and carries toner. The magnetic roller is opposed to the developing roller, so as to perform supply of the toner to the developing roller and removal of the toner from the developing roller with a magnetic brush. The transformer has a primary side connected to the capacitor and outputs an AC voltage from a secondary side to be applied to the developing roller. The control signal generating unit generates a control signal to be input to the capacitor. When the duty ratio of the control signal is changed, the control signal generating unit adjusts a DC bias value of the control signal in accordance with the change of the duty ratio so that a DC component of the control signal is the same before and after the duty ratio of the control signal is changed.

In addition, a method for controlling a developing device according to a second aspect of the present disclosure, for solving the above-mentioned problem, includes the steps of permitting a developing roller opposed to a photosensitive drum to carry toner, disposing a magnetic roller opposed to the developing roller, performing supply of the toner to the developing roller and removal of the toner from the developing roller with a magnetic brush, connecting a capacitor to a primary side of the transformer, permitting the transformer to output an AC voltage from a secondary side to be applied to the developing roller, generating a control signal to be input to the capacitor, and when the duty ratio of the control signal is changed, adjusting a DC bias value of the control signal in accordance with the change of the duty ratio so that a DC component of the control signal is the same before and after the duty ratio of the control signal is changed.

Further features and advantages of the present disclosure will become apparent from the description of embodiments given below.

DETAILED DESCRIPTION

Hereinafter, first and second embodiments of the present disclosure are described with reference to FIGS. 1 to 12. First, with reference to FIGS. 1 to 10, the first embodiment is described. In the following description, an electrophotographic tandem printer 100 (corresponding to the image forming apparatus) including a developing device 1 is exemplified. However, elements such as structures and layouts described in the first and second embodiment are merely examples for description and should not be interpreted to limit the scope of the disclosure.

First Embodiment

Figure 1:
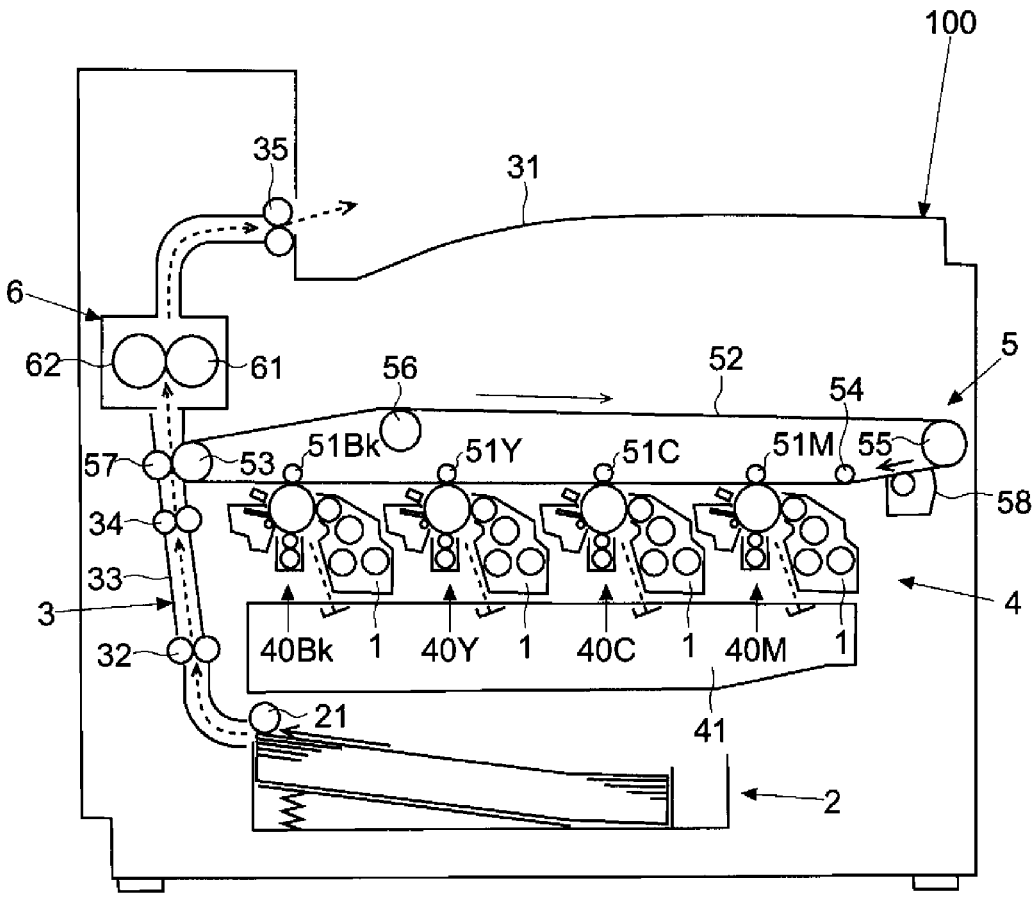
FIG. 1 is a cross sectional view illustrating a structure of a printer.
Figure 2:
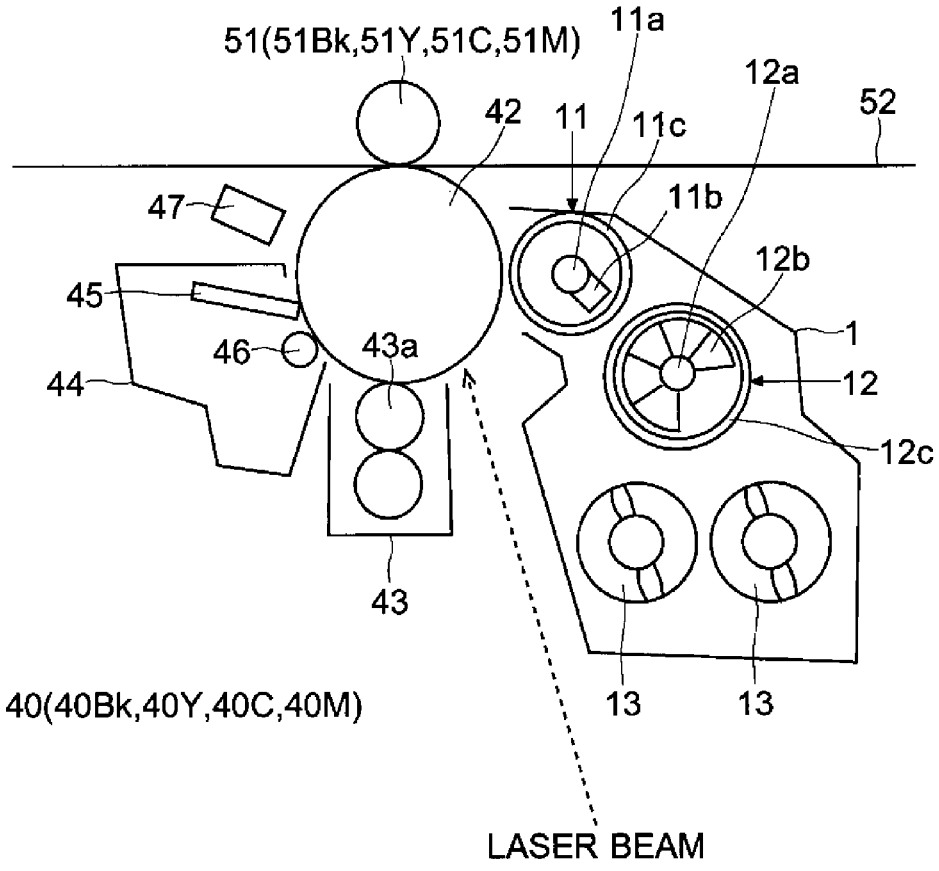
FIG. 2 is a cross sectional view of an image forming unit.

First, with reference to FIGS. 1 and 2, a printer 100 according to the first embodiment is described. FIG. 1 is a cross sectional view illustrating a structure of a printer 100. FIG. 2 is a cross sectional view of an image forming unit 40.

As illustrated in FIG. 1, the printer 100 includes a paper sheet feeder 2, a transport portion 3, an image forming portion 4, an intermediate transfer unit 5, a fixing unit 6, and the like disposed inside a main body thereof.

The paper sheet feeder 2 contains various paper sheets such as plain paper sheets (OA paper sheets), OHP sheets, label paper sheets, and the like. The paper sheet feeder 2 includes a paper feed roller 21 that is driven to rotate by a drive mechanism (not shown) such as a motor and feeds the paper sheets one by one to the transport portion 3. Further, the transport portion 3 guides the sheet fed from the paper sheet feeder 2 to a discharge tray 31 via the intermediate transfer unit 5 and the fixing unit 6. The transport portion 3 is equipped with a transport roller pair 32, a guide 33, a registration roller pair 34, a discharge roller pair 35, and the like. The registration roller pair 34 makes the transported sheet wait before the intermediate transfer unit 5 and sends out the same in synchronization with the toner image being formed.

The image forming portion 4 forms the toner image on the basis of image data of the image to be formed. Further, the image forming portion 4 includes image forming units 40Bk to 40M of four colors and an exposing device 41. Specifically, the image forming portion 4 includes the image forming unit 40Bk for forming a black image, the image forming unit 40Y for forming a yellow image, the image forming unit 40C for forming a cyan image, and the image forming unit 40M for forming a magenta image.

Here, with reference to FIG. 2, the image forming units 40Bk to 40M are described in detail. Note that the image forming units 40Bk to 40M form images of different colors, but they have basically the same structure. Therefore, the image forming unit 40Bk is exemplified in the following description, and symbols Bk, Y, C, and M indicating colors are omitted unless otherwise noted. In addition, the same members are denoted by the same numerals or symbols in an image forming unit 40.

The image forming unit 40 includes a photosensitive drum 42. The photosensitive drum 42 is supported in a rotatable manner. The photosensitive drum 42 is driven by a motor 74 (see FIG. 3) to rotate at a predetermined circumferential speed. The photosensitive drum 42 includes a base made of a metal such as aluminum and a photosensitive layer made of OPC or amorphous silicon formed on the outer circumference surface. Further, the photosensitive drum 42 is an image carrying member for carrying a toner image on the circumference surface through charging, exposing, and developing processes. Note that the photosensitive drum 42 of this embodiment is a positive charge type (and toner that is positively charged is used).

A charging device 43 of the image forming unit 40 includes a charging roller 43*a*. The charging roller 43*a* contacts with the corresponding photosensitive drum 42 and rotates together with the photosensitive drum 42. In addition, a voltage for charging the photosensitive drum 42 is applied to the charging roller 43*a*. Then, the charging device 43 charges the surface of the photosensitive drum 42 at a uniform potential.

The exposing device 41 disposed below the image forming units 40 emits a laser beam toward each photosensitive drum 42. The exposing device 41 includes optical system members inside, such as a plurality of semiconductor laser devices (laser diodes), polygon mirrors, polygon motors, fθ lenses, and mirrors (not shown). The exposing device 41 uses these optical system, members to irradiate the charged photosensitive drums 42 with light signals (laser beams as illustrated by broken lines) based on image signals decomposed for individual colors from the image data. In this way, the exposing device 41 performs scan and exposure of each photosensitive drum 42. Thus, an electrostatic latent image according to the image data is formed on the circumference surface of each photosensitive drum 42. Specifically the photosensitive drum 42 of the first embodiment is positively charged, and a potential of a part irradiated with light is decreased. The positively charged toner is adhered to the low potential part of the photosensitive drum 42. Note that it is possible to use other type of the exposing device 41 such as one using an array type LED instead of the laser type.

The developing device 1 of the image forming unit 40 contains developer containing toner and magnetic carrier (so-called two-component developer). The developing device 1 of the image forming unit 40Bk contains black developer, the same of the image forming unit 40Y contains yellow developer, the same of the image forming unit 40C contains cyan developer, and the same of the image forming unit 40M contains magenta developer. Note that the developing device 1 is connected to a container (not shown) for containing the toner, and hence the toner is successively added to the developing device 1 as the toner is consumed.

The developing device 1 includes a developing roller 11, a magnetic roller 12, and a transporting member 13. Further, the developing roller 11 is opposed to the corresponding photosensitive drum 42 so that axis lines thereof are parallel to each other. In addition, a gap (clearance) is formed between the developing roller 11 and the corresponding photosensitive drum 42. The gap has a predetermined width (for example, 1 mm or smaller).

When printing is performed, a thin layer of toner is formed on the circumference surface of the developing roller 11 so that the developing roller 11 carries the toner to be charged. A voltage is applied to the developing roller 11 for causing the toner to fly toward the photosensitive drum 42 so as to develop the electrostatic latent image (see FIG. 4 and the like, and details will be described later).

The magnetic roller 12 of the developing device 1 is opposed to the corresponding developing roller 11, and axis lines thereof are parallel to each other. A voltage is applied to the magnetic roller 12 for supply of the toner to the developing roller 11 and collection or removal of the toner (see FIG. 4 and the like, and details will be described later).

The developing device 1 is equipped with two transporting members 13. The transporting members 13 are disposed below the magnetic roller 12. The transporting member 13 includes a helical blade, which stirs and transports the developer containing the toner and the carrier. By friction between the toner and the carrier during this transportation, the toner is charged. The two transporting members 13 have different rotation directions.

A roller shaft 11*a* of the developing roller 11 and a roller shaft 12*a* of the magnetic roller 12 are fixed and supported by a shaft support member (not shown) or the like. Further, a magnet 11*b* extending in the axial direction having a substantially rectangular cross section is attached to the roller shaft 11*a* of the developing roller 11. In addition, a magnet 12*b* extending in the axial direction having a substantially fan-shaped cross section is attached to the roller shaft 12*a* of the magnetic roller 12. In addition, the developing roller 11 has a cylindrical sleeve 11*c* that does not contact with the magnet 11*b* and covers the magnet 11*b*. In addition, the magnetic roller 12 also has a cylindrical sleeve 12*c* that does not contact with the magnet 12*b* and covers the magnet 12*b*. The sleeves 11*c* and 12*c* are driven to rotate by a drive mechanism (not shown).

Further, the magnet 11*b* of the developing roller 11 and the magnet 12*b* of the magnetic roller 12 are opposed to each other with different poles at the position where the developing roller 11 and the magnetic roller 12 are opposed. Thus, a magnetic brush of the magnetic carrier is formed between the developing roller 11 and the magnetic roller 12. The toner is supplied to the developing roller 11 by rotation of the sleeve 12*c* of the magnetic roller 12 carrying the magnetic brush and by voltage application to the magnetic roller 12. Thus, a thin layer of the toner is formed on the sleeve 11*c* of the developing roller 11. In addition, after the electrostatic latent image on the surface of the photosensitive drum 42 is developed, the magnetic brush tears off and collects the toner remaining on the surface of the developing roller 11.

A cleaning device 44 of the image forming unit 40 cleans the photosensitive drum 42. The cleaning device 44 includes a blade 45 extending in the axial direction of the photosensitive drum 42 and a rubbing roller 46 that rubs the surface of the photosensitive drum 42 so as to remove the remaining toner and the like. The blade 45 and the rubbing roller 46 contact with the photosensitive drum 42 so as to scrape and remove dirty things such as residual toner on the photosensitive drum 42. In addition, a charge neutralizer 47 is disposed for irradiating the photosensitive drum 42 with light so as to eliminate static electricity. The charge neutralizer 47 is an array type LED.

Description is continued with reference to FIG. 1 again. The intermediate transfer unit 5 receives the toner image transferred as primary transfer from the photosensitive drum 42 and performs secondary transfer onto the sheet. The intermediate transfer unit 5 includes a plurality of primary transfer rollers 51Bk to 51M, an intermediate transfer belt 52, a drive roller 53, follower rollers 54, 55, and 56, a secondary transfer roller 57, a belt cleaning device 58, and the like.

The intermediate transfer belt 52 is constituted of dielectric resin or the like. The intermediate transfer belt 52 is stretched around the primary transfer rollers 51Bk to 51M, the drive roller 53, and the follower rollers 54 to 56. Then, the drive roller 53 connected to a drive mechanism (not shown) such as a motor is driven to rotate. Thus, the intermediate transfer belt 52 goes around in the clockwise direction in the paper plane of FIG. 1. Each of the primary transfer rollers 51Bk to 51M and the corresponding photosensitive drum 42 sandwich the endless intermediate transfer belt 52. A voltage for the primary transfer is applied to the primary transfer rollers 51Bk to 51M. The toner images (of black, yellow, cyan, and magenta colors) formed by the image forming units 40 are overlaid sequentially without misregistration and are transferred as the primary transfer onto the intermediate transfer belt 52.

In addition, the drive roller 53 and the secondary transfer roller 57 sandwich the intermediate transfer belt 52 so as form a secondary transfer nip. A predetermined voltage is applied to the secondary transfer roller 57. Then, the toner image on the intermediate transfer belt 52 constituted of the overlaid color images is transferred as the secondary transfer onto the sheet. Note that remaining toner and the like on the intermediate transfer belt 52 after the secondary transfer are removed by the belt cleaning device 58 and are collected.

The fixing unit 6 is disposed on the downstream side of the secondary transfer roller 57 in the sheet transport direction. The fixing unit 6 includes a fixing roller 61 in which a heat generating source is embedded, and a pressure roller 62 that is pressed to the fixing roller 61. The fixing unit 6 permits the sheet with the transferred toner image to pass through the nip between the fixing roller 61 and the pressure roller 62. When the sheet passes through the fixing nip, the toner image is heated and pressed. As a result, the toner image is fixed to the sheet. A discharge roller pair 37 discharges the sheet after fixing onto the discharge tray 31. Thus, printing of one paper sheet is finished.

(Hardware Structure of Printer 100)

Figure 3:
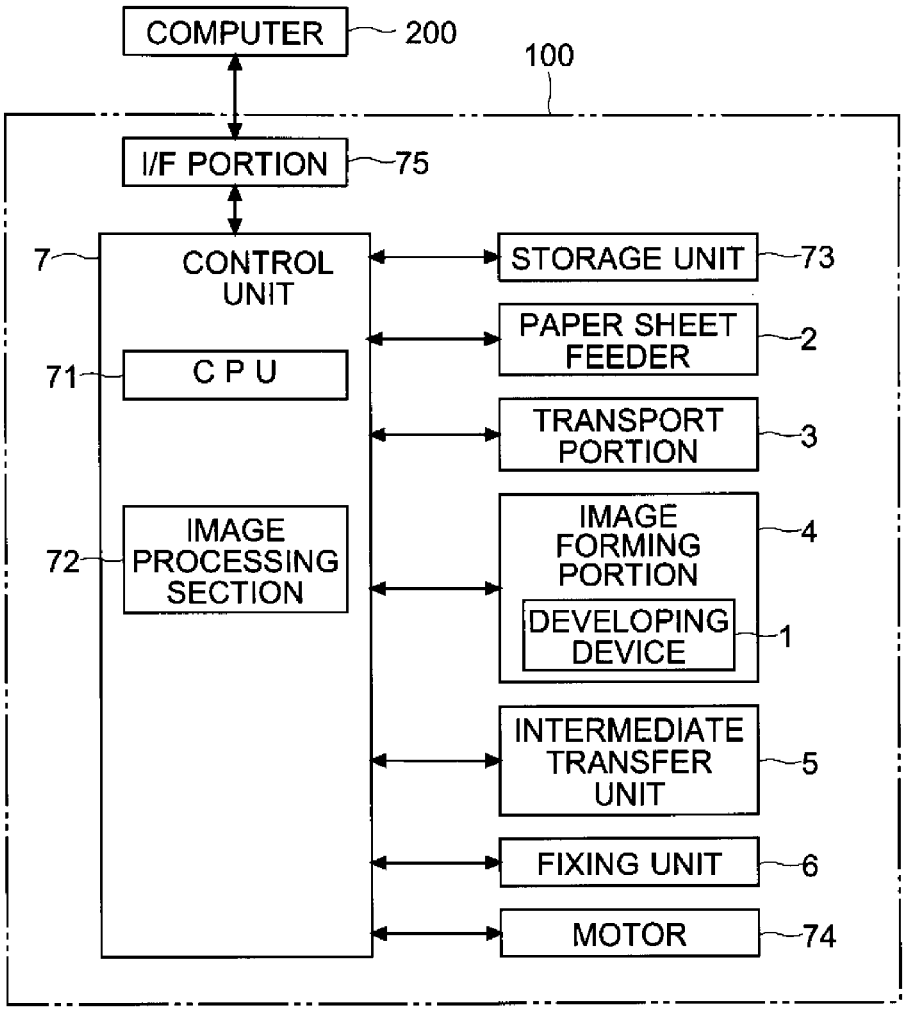
FIG. 3 is a block diagram illustrating a hardware structure of a printer.

Next, with reference to FIG. 3, a hardware structure of the printer 100 according to the first embodiment is described. FIG. 3 is a block diagram illustrating a hardware structure of the printer 100.

As illustrated in FIG. 3, the printer 100 includes a control unit 7. The control unit 7 controls individual portions of the apparatus. The control unit 7 includes a circuits and elements such as a CPU 71 and an image processing section 72 for performing processes. In addition, the printer 100 includes a storage unit 73. The storage unit 73 is constituted by combining a nonvolatile storage device such as a ROM or a flash ROM and a volatile storage device such as a RAM. Note that it is possible to dispose a plurality types of divided control units (substrates) in accordance with functions and roles, such as an engine control unit for controlling a print engine and a main control unit for performing general control and image processing.

The CPU 71 is an operation processing unit for performing control of individual portions of the printer 100 and operation on the basis of a control program and control data stored in the storage unit 73. The storage unit 73 stores the control program for the printer 100 and various data such as the control data. Further, the storage unit 73 can also store a program and data related to voltage application setting for the developing roller 11 and the magnetic roller 12, such as set values of a duty ratio and a DC bias voltage for voltage application to the developing roller 11 and the magnetic roller 12.

Further, the control unit 7 is connected to the paper sheet feeder 2, the transport portion 3, the image forming portion 4, the intermediate transfer unit 5, the fixing unit 6, and the like, and hence controls actions of the individual portions so that image formation can be appropriately performed on the basis of the control program and data stored in the storage unit 73. In addition, the control unit 7 controls one or more motors 74 disposed in the printer 100. The control unit 7 controls the motor 74 to rotate so that various rotating members such as the photosensitive drum 42, the developing roller 11, and the magnetic roller 12 are rotated. Utilizing the drive of this motor 74, the sleeves 11*c* of the developing roller 11 and sleeves 12*c* of the magnetic roller 12 rotate.

In addition, the control unit 7 is connected to a computer 200 such as a personal computer or a server via an I/F portion 75 (interface portion). The computer 200 is a transmission source of print data including content to be printed by the printer 100. The print data includes print setting data, image data, and the like. The control unit 7 controls the image processing section 72 to perform image processing on the basis of the received print data so as to generate image data for the exposing device 41. The exposing device 41 receives the generated image data and forms the electrostatic latent image on the photosensitive drum 42.

(Voltage Application in Developing Device 1)

Figure 4:
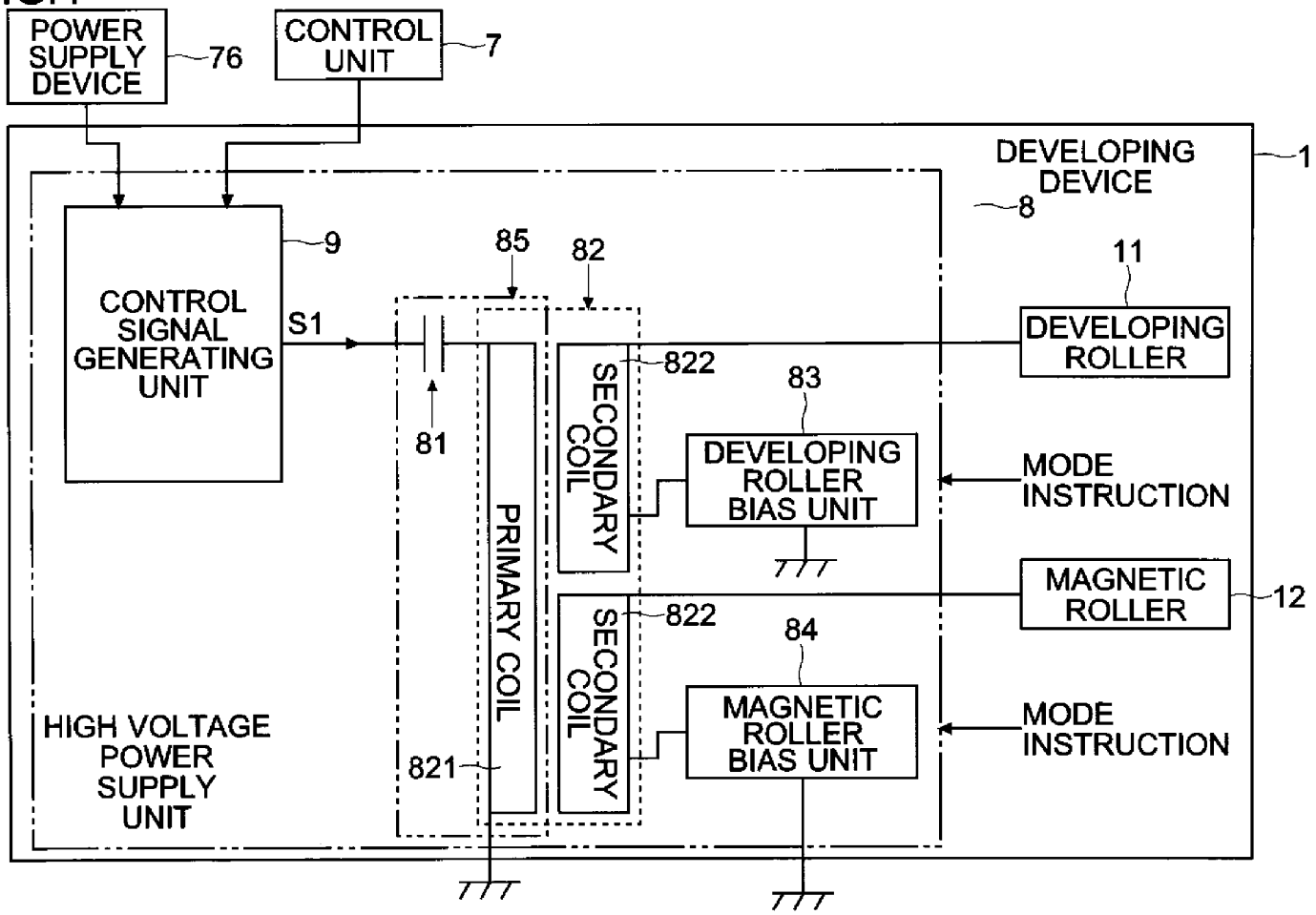
FIG. 4 is a block diagram illustrating a developing device.

Next, with reference to FIG. 4, an example of voltage application mode in the developing device 1 according to the first embodiment is described. FIG. 4 is a block diagram illustrating an example of the developing device 1.

Voltages are applied to the developing roller 11 and the magnetic roller 12 for developing the electrostatic latent image with toner, for supplying toner front the magnetic roller 12 to the developing roller 11, and for removing the toner from the developing roller 11. In other words, in order to appropriately move the toner, voltages are applied to the developing roller 11 and the magnetic roller 12.

The developing device 1 includes a high voltage power supply unit 8 for applying voltages to the developing roller 11 and the magnetic roller 12. The high voltage power supply unit 8 steps up the voltage and applies (outputs) the obtained voltage to the developing roller 11 and the magnetic roller 12.

The high voltage power supply unit 8 includes a control signal generating unit 9, a capacitor 81, a transformer 82, a developing roller bias unit 83, and a magnetic roller bias unit 84. Because the start timing and the end timing of the developing process are different for each developing device 1, the high voltage power supply unit 8 is disposed for each developing device 1 (for one combination of the developing roller 11 and the magnetic roller 12).

An electrolytic capacitor can be used as the capacitor 81. One of electrodes of the capacitor 81 is connected to the control signal generating unit 9. In addition, the other electrode of the capacitor 81 is connected to a primary coil 821 of the transformer 82. Thus, the capacitor 81 and the transformer 82 are connected to each other as a serial circuit 85 (the serial circuit 85 of the capacitor 81 and the transformer 82 is illustrated by a triple-dot-dashed line in FIG. 4). The capacitor 81 removes a DC component from a control clock signal S1 (voltage) output from the control signal generating unit 9 and supplies the obtained, signal to the primary coil 821 of the transformer 82.

Further, a power supply device 76 is disposed inside the printer 100. The power supply device 76 is connected to an external power source such as a commercial electric power. The power supply device 76 performs rectifying, smoothing, and the like so as to output a DC voltage.

The control signal generating unit 9 outputs the control clock signal S1 (corresponding to the control signal) for controlling the duty ratio or the like of the AC voltage to be applied to the developing roller 11 in accordance with an instruction from the control unit 7. The control signal generating unit 9 changes the duty ratio of the control clock signal S1 on the basis of the instruction from the control unit 7 corresponding to a mode of the printer 100 and execution or inexecution of the developing process. The control signal generating unit 9 supplies (inputs) the capacitor 81 with the control clock signal S1 having a signal value adjusted in accordance with the duty ratio (the frequency of the control clock signal S1 is approximately a few kilohertz, for example, approximately 3 to 5 kHz, and the details will be described later). Then, the AC voltage having the same duty ratio as the control clock signal S1 output from the control signal generating unit 9 is applied to the developing roller 11.

The capacitor 81 is connected to the control signal generating unit 9. In addition, the capacitor 81 is connected to a primary side (primary coil 821) of the transformer 82. The capacitor 81 removes a DC component from the control clock signal S1 and supplies (inputs) the signal (voltage) to the primary coil 821 of the transformer 82. In other words, the capacitor 81 supplies (inputs) the AC waveform without a DC component to the transformer 82.

The transformer 82 steps up the voltage supplied to the primary side and outputs the stepped-up voltage. Further, the secondary side (secondary coil 822) has two outputs. One of the outputs is connected to the developing roller 11, and the other output is connected to the magnetic roller 12. Note that the step-up ratio may be different between the outputs. In addition, a developing roller bias unit 83 is disposed for biasing the AC voltage to be applied to the developing roller 11. Similarly, in addition, a magnetic roller bias unit 84 is disposed for biasing the AC voltage to be applied to the magnetic roller 12. The AC voltage biased with a DC voltage by the developing roller bias unit 81 is applied to the developing roller 11. In addition, the AC voltage biased with a DC voltage by the magnetic roller bias unit 84 is applied to the magnetic roller 12.

The developing roller bias unit 83 and the magnetic roller bias unit 84 are converters that receive the output voltage of the power supply device 76 so as to step up the voltage. Further, the developing roller bias unit 83 and the magnetic roller bias unit 84 are circuits capable of changing the output. In other words, the developing roller bias unit 83 and the magnetic roller bias unit 84 can change a voltage value for the biasing.

(Voltage Application Mode in Developing Device 1)

Figure 5:
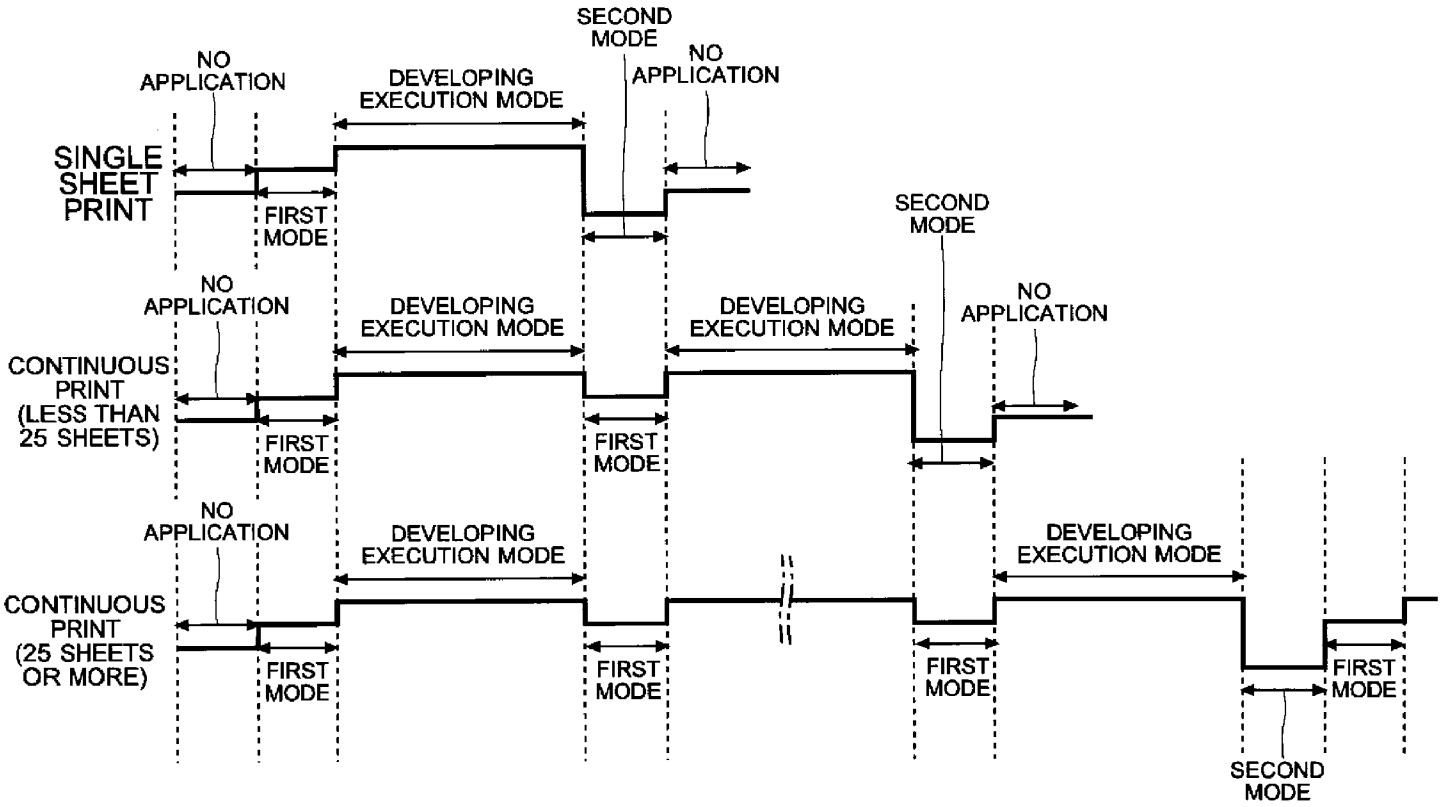
FIG. 5 is a timing chart illustrating waveforms of voltages in a high voltage power supply unit of the developing device.

Next, with reference to FIG. 5, a voltage application mode in the developing device 1 of the first embodiment is described. FIG. 5 is an explanatory diagram illustrating an example of a voltage application mode transition.

As the modes, the developing device 1 of the first embodiment has a developing execution mode in which the developing of the electrostatic latent image with toner is performed, and a developing inexecution mode in which the developing of the electrostatic latent image is not performed. In addition, the developing inexecution mode includes a first mode and a second mode. The high voltage power supply unit 8 of the developing device 1 changes DC voltage values to be applied to the developing roller 11 and the magnetic roller 12, and the duty ratio of the control clock signal S1 (duty ratio of the voltage applied to the capacitor 81), in accordance with the mode. Note that it is not necessary to apply voltages to the developing roller 11 and the magnetic roller 12 when printing is not performed. Therefore, the states (modes) of the developing device 1 also include a non-application state in which voltages are not applied to the developing roller 11 and the magnetic roller 12, besides the above-mentioned three modes (the developing execution mode, the first mode, and the second mode).

The developing execution mode is a mode in which the toner flies so as to develop the electrostatic latent image formed on the photosensitive drum 42. The first mode (one type of a developing unexecuted mode) is a mode before changing to the developing execution mode. In this first mode, the toner is supplied to the developing roller 11, and the thin layer of the toner is prepared on the surface of the developing roller 11 (sleeve 11*c*). The second mode (one type of the developing unexecuted mode) is a mode in which the toner is taken off from the surface of the developing roller 11 and is collected. In this second mode, the toner on the surface of the developing roller 11 is exchanged so that adhesion of the toner onto the developing roller 11 is prevented.

First, in the developing execution mode, the AC voltage having a predetermined peak-to-peak voltage is applied to the developing roller 11. In addition, in the developing execution mode, in order to supply toner to the developing roller 11, the control unit 7 sets the output value of the developing roller bias unit 83 smaller than the output value of the magnetic roller bias unit 84. In other words, the developing roller bias unit 83 and the magnetic roller bias unit 84 output the DC voltages in a relationship that the output voltage of the magnetic roller bias unit 84 is larger than the output voltage of the developing roller bias unit 83. Thus, the positively charged toner can easily move in the direction from the magnetic roller 12 to the developing roller 11.

Next, the first mode is a mode of forming the thin layer of toner on the circumference surface of the developing roller 11 before printing. Therefore, it is necessary to apply the bias so that the charged toner moves from the magnetic roller 12 to the developing roller 11. Therefore, similarly to the developing execution mode, the control unit 7 sets the output value of the developing roller bias unit 83 smaller than the output value of the magnetic roller bias unit 84. In addition, in the first mode, it is possible to apply the AC voltage having a predetermined peak-to-peak voltage to the developing roller 11.

In addition, the second mode is a mode in which the toner is taken off from the circumference surface of the developing roller 11 and is collected to the magnetic roller 12. For this purpose, it is necessary to apply a bias so that the toner can easily move from the developing roller 11 to the magnetic roller 12. Therefore, in the second mode, the control unit 7 sets the output value of the developing roller bias unit 83 larger than the output value of the magnetic roller bias unit 84. Thus, the positively charged toner moves in the direction from the developing roller 11 toward the magnetic roller 12. In addition, in the second mode too, it is possible to apply the AC voltage having a predetermined peak-to-peak voltage to the developing roller 11.

Note that the first mode or the second mode changes to another mode after the time while the developing roller 11 rotates one turn or more passes. In other words, the first mode and the second mode continue at least for the time while the developing roller 11 rotates one turn or more.

The control unit 7 inputs a signal for instructing the developing roller bias unit 83 and the magnetic roller bias unit 84 the mode in accordance with the state of the printer 100 (see FIG. 4). The developing roller bias unit 83 and the magnetic roller bias unit 84 change the output values in accordance with the instructed mode.

Further, FIG. 5 illustrates three examples of mode transition. First, the uppermost part in FIG. 5 illustrates a state transition when only one sheet is printed. When only one sheet is printed, the control unit 7 controls the high voltage power supply unit 8 so that the developing device 1 becomes the first mode from the non-application state before starting the developing. Then, the control unit 7 controls so that the thin layer of toner is formed on the surface of the developing roller 11 (sleeve 11*c*). After that, the control unit 7 controls the high voltage power supply unit 8 so that the developing device 1 becomes the developing execution mode. Then, the control unit 7 controls so that toner supply from the magnetic roller 12 to the developing roller 11 is continued. Then, when the developing is completed (printing is completed), the control unit 7 controls the high voltage power supply unit 8 so that the developing device 1 becomes the second mode. The control unit 7 controls so that the toner is collected from the developing roller 11. After that, the developing device 1 becomes the non-application state.

Next, the middle part in FIG. 5 illustrates a state transition when a plurality of pages less than 25 pages are printed continuously. The process until starting the developing is the same as in the case where only one sheet is printed. Then, after the developing of a toner image corresponding to a first page is started, between paper sheets, the control unit 7 controls the high voltage power supply unit 8 so that the developing device 1 operates in the first mode. Therefore, the first mode and the developing execution mode are repeated. Then, when the developing (printing) process in the job is completed, the control unit 7 controls the high voltage power supply unit 8 so that the developing device 1 operates the second mode. After that, the developing device 1 becomes the non-application state.

Further, a lowermost part in FIG. 5 illustrates a state transition when 25 or more pages are continuously printed. The process until starting the developing is the same as in the case where only one sheet is printed. Then, after the developing of a toner image corresponding to a first page is started, between paper sheets, the control unit 7 controls the high voltage power supply unit 8 so that the developing device 1 operates in the first mode. Therefore, in principle, the first mode and the developing execution mode are repeated. Then, when 25 sheets are printed, the control unit 7 controls the high voltage power supply unit 8 so that the developing device 1 operates in the second mode. Then, the control unit 7 refreshes the toner on the surface of the developing roller 11 (circumference surface of the sleeve 11*c*). Note that in this description, with reference to 25 sheets, the second mode is performed (the refresh is performed) every time when 25 sheets are printed, as an example. However, without limiting to 25 sheets, it is possible to perform the refresh at any timing, namely every time when 26 or more sheets, or 24 or less sheets are printed. After the second mode, the control unit 7 controls the high voltage power supply unit 8 again so that the developing device 1 operates in the first mode. After that, the control unit 7 controls so that the developing device 1 operates in the developing execution mode, and hence the developing process is restarted. When the developing (printing) process is completed, the control unit 7 controls the high voltage power supply unit 8 so that the developing device 1 operates in the second mode. After that, the developing device 1 becomes the non-application state.

(Duty Ratio in Each Mode)

Figure 6:
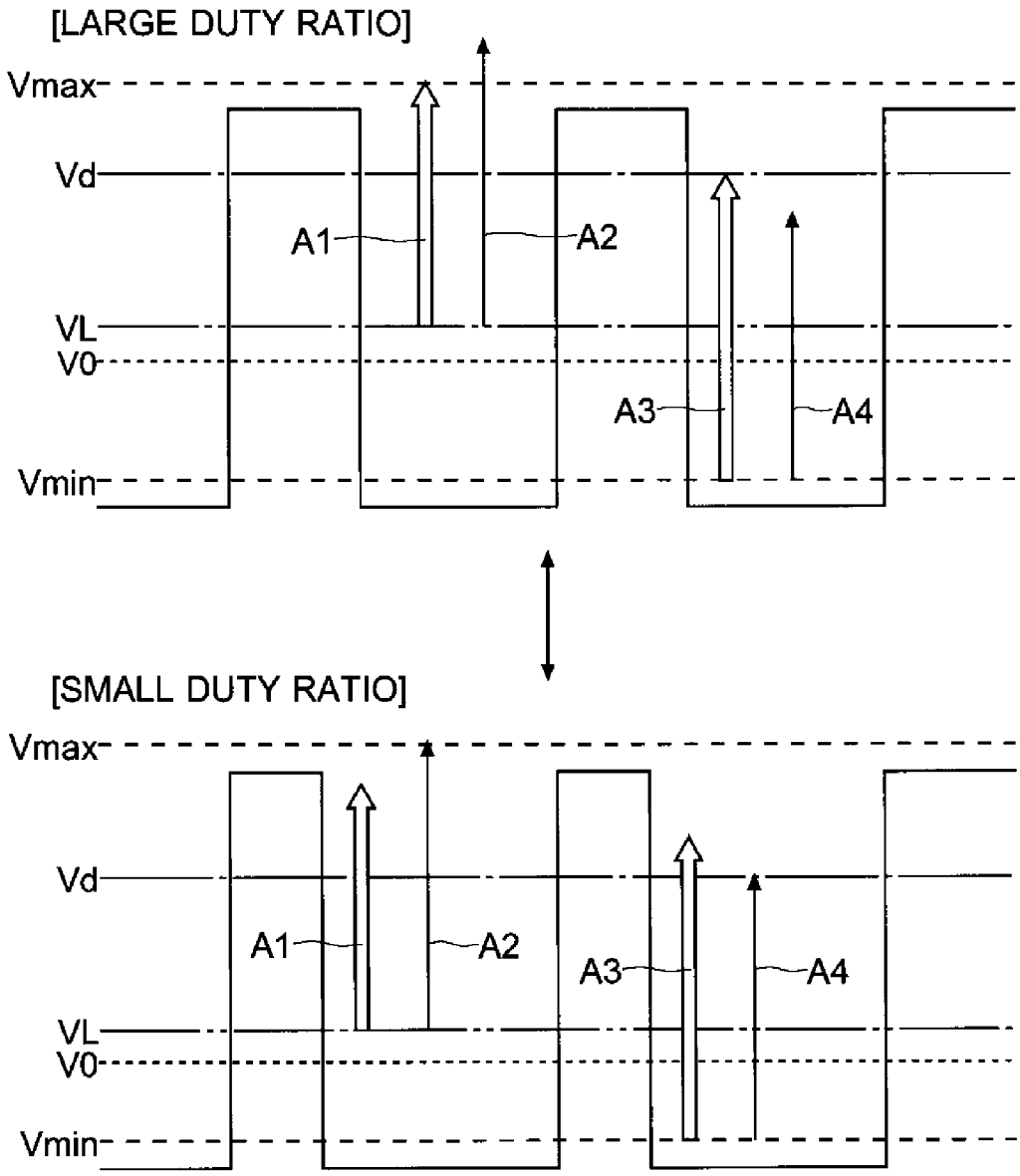
FIG. 6 is an explanatory diagram for describing an influence due to a difference of a duty ratio of a voltage applied to a developing roller.

Next, with reference to FIG. 6, the voltage application mode and a duty ratio change in the developing device 1 of the first embodiment are described. FIG. 6 is an explanatory diagram for describing an influence of a duty ratio difference of the voltage applied to the developing roller 11.

In the printer 100 of the first embodiment, the duty ratio of the control clock signal S1 is changed so that the duty ratio of the voltage supplied to the capacitor 81 is changed. Thus, it is possible to change the duty ratio of the AC voltage applied to the developing roller 11. Specifically, the control signal generating unit 9 changes the duty ratio of the control clock signal S1 by a mode of the developing device 1. Further, the control signal generating unit 9 sets the duty ratio of the control clock signal S1 (voltage applied to the developing roller 11) larger in the developing execution mode than in the first mode and the second mode.

First, with reference to FIG. 6, there is described that the toner flies differently depending on the duty ratio. FIG. 6 illustrates an example of a voltage waveform applied to the developing roller 11. In FIG. 6, the duty ratio (approximately 40%) of the voltage applied to the developing roller 11 illustrated in the upper timing chart is larger than the duty ratio (approximately 30%) of the voltage applied to the developing roller 11 illustrated in the lower timing chart.

First, the solid line in each timing chart of FIG. 6 illustrates a waveform indicating a voltage variation applied to the developing roller 11. Therefore, the vertical axis in each timing chart indicates a voltage amplitude. The peak-to-peak voltage in this waveform is set in the range of 1 to 2 kV, for example. Further, a V0 line (illustrated by a broken line) in FIG. 6 indicates 0 V (ground).

The capacitor 81 removes a DC component. Therefore, in the peak-to-peak voltage of the waveform indicating the voltage variation applied to the developing roller 11, V0 indicates a position where the product of a high time period and the amplitude is equal to the product of a low time period and the amplitude in one period (area center value V0, integral average value in one period, DC component). For instance, supposing that the duty ratio is 40% and the peak-to-peak voltage is 1 kV in a rectangular wave, a potential difference between the V0 line and a positive peak is 600 V. In contrast, a potential difference between the V0 line and a negative peak is 400 V.

In addition, a VL line (illustrated by a double-dot-dashed line) in each timing chart of FIG. 6 indicates a potential of the exposed photosensitive drum 42 (approximately 100 to 200 V in this embodiment). On addition, a Vd line (illustrated by a dashed dotted line) in each timing chart of FIG. 6 indicates a potential of the photosensitive drum 42 in the charged state (approximately 400 to 600 V in this embodiment). Further, a Vmax line (upper line illustrated by a wide interval broken line) in each timing chart of FIG. 6 indicates a positive peak value of the voltage applied to the developing roller 11 when being biased by the developing roller bias unit 83. A Vmin line (lower line illustrated by a wide interval broken line) in each timing chart of FIG. 6 indicates a negative peak value of the voltage applied to the developing roller 11 when being biased by the developing roller bias unit 83.

In the developing process, the positively charged toner flies from the developing roller 11 to the photosensitive drum 42 at an exposed portion. Therefore, as a potential difference between the potential (VL) of the exposed photosensitive drum 42 and Vmax is larger, an electrostatic force acting on the toner becomes larger so that the toner moves faster.

Here, as illustrated in FIG. 6, a potential difference (indicated by a solid line arrow A2 in FIG. 6) between the potential (VL) of the exposed photosensitive drum 42 and Vmax when the duty ratio of the voltage applied to the developing roller 11 is small becomes larger than a potential difference (indicated by a white-colored arrow A1 in FIG. 6) between the potential (VL) of the exposed photosensitive drum 42 and Vmax when the duty ratio of the voltage applied to the developing roller 11 is large. This is based on a concept of area center (integral average value in one period). Therefore, as the duty ratio is smaller, the toner can quickly fly so that the toner can be quickly adhered to exposed dots. Therefore, it is said that reproducibility of one dot becomes higher as the duty ratio is smaller.

However, it is experimentally known that as the duty ratio of the voltage applied to the developing roller 11 is smaller, unevenness appears more easily in the developed toner image. When a solid image having a uniform density is printed, as the duty ratio of the voltage applied to the developing roller 11 is smaller, unevenness of density appears more easily in the printed result (which may be referred to as "developing drive unevenness"). The developing roller 11 and the photosensitive drum 42 have a manufacturing error and an attachment error, and hence a gap between the photosensitive drum 42 and the developing roller 11 is not the same in all positions in the axial direction. Further, the gap always fluctuates along with rotations of the photosensitive drum 42 and the sleeve 11*c* of the developing roller 11. Although a mechanism of generating the developing drive unevenness is not completely elucidated, it is considered that as the reproducibility of one dot becomes higher, a fluctuation of the gap causes larger unevenness.

On the other hand, it is experimentally known that when the duty ratio of the voltage applied to the developing roller 11 is increased, a leakage (discharge) is apt to occur. The gap between the photosensitive drum 42 and the developing roller 11 is very small (1 mm or small). In addition, the leakage occurs more easily as a potential difference between the photosensitive drum 42 and the developing roller 11 becomes larger.

Here, in the developing device 1 of the first embodiment, the leakage is apt to occur when the voltage applied to the developing roller 11 becomes small due to characteristics of the photosensitive layer of the photosensitive drum 42. In other words, the leakage is apt to occur as the negative peak voltage applied to the developing roller 11 is smaller (larger in the negative direction). Note that the leakage may occur more easily as the voltage applied to the developing roller 11 is larger due to charge characteristics of the toner or characteristics of the photosensitive drum 42.

Further, as illustrated in FIG. 6, on the basis of the concept of area center, a potential difference (indicated by a white-colored arrow A3 in FIG. 6) between a potential (Vd) of the charged photosensitive drum 42 when the duty ratio of the voltage applied to the developing roller 11 is large and a potential (Vmin) when a voltage applied to the developing roller 11 is the negative peak is larger than a potential difference (indicated by a solid line arrow A4 in FIG. 6) between the potential (Vd) of the charged photosensitive drum 42 when the duty ratio is small and the potential (Vmin) when the voltage applied to the developing roller 11 is the negative peak. In other words, as the duty ratio of the voltage applied to the developing roller 11 is larger, the leakage occurs more easily in the developing device 1 of the first embodiment.

When the leakage occurs, potential of the photosensitive drum 42 may be lowered so that the toner is adhered to the same. When the toner is adhered to the photosensitive drum 42 in a period other than the developing execution period, the intermediate transfer belt 52 or the secondary transfer roller 57 may be dirty with the toner. Thus, the toner may adhere to the paper sheet so that the paper sheet may become dirty. In addition, if the current in the leakage is large, a very small hole may be formed in the photosensitive drum 42 so that image quality of a toner image formed afterward may be deteriorated.

Therefore, in the printer 100 of the first embodiment, the high voltage power supply unit 8 (control signal generating unit 9) sets the duty ratio of the voltage to be applied to the developing roller 11 larger in the developing execution mode than in the first mode or in the second mode, in order to suppress unevenness of the toner image so that image quality is improved. In other words, in the developing execution mode, the duty ratio of the control clock signal S1 is set large. In contrast, in order to prevent occurrence of leakage, in the first mode and in the second mode, the high voltage power supply unit 8 (control signal generating unit 9) sets the duty ratio of the voltage applied to the developing roller 11 smaller than that in the developing execution mode. In other words, in the first mode and in the second mode, the duty ratio of the control clock signal S1 is set small. In this way, duty ratios in the developing execution mode, in the first mode, and in the second mode are determined in advance.

In accordance with a printing step, a state of the printer 100, and the number of copies to be printed, the control unit 7 instructs the control signal generating unit 9 about the mode of the developing device 1 (indicates the developing execution mode, the first mode, or the second mode). When the exposing device 41 starts the exposure, the control unit 7 instructs the control signal generating unit 9 to change to the developing execution mode. In addition, when the exposing device 41 finishes the exposure, the control unit 7 instructs the control signal generating unit 9 to change to the first mode or the second mode. The control signal generating unit 9 changes the duty ratio of the control clock signal S1 in accordance with the mode indication from the control unit 7. Alternatively, the control unit 7 may give a signal indicating a value of the duty ratio to the control signal generating unit 9, and the control signal generating unit 9 may change the duty ratio in accordance with the signal.

(Control Clock Signal S1 for Each Duty Ratio Generated by Control Signal Generating Unit 9)

Figure 7:
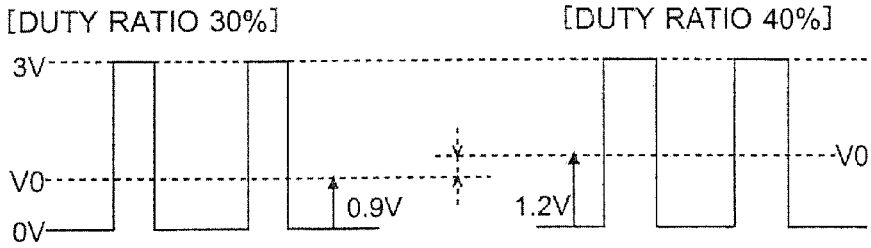
FIG.7 Prior Art
FIG. 7 is a timing chart for describing a conventional change of the duty ratio.
Figure 8:
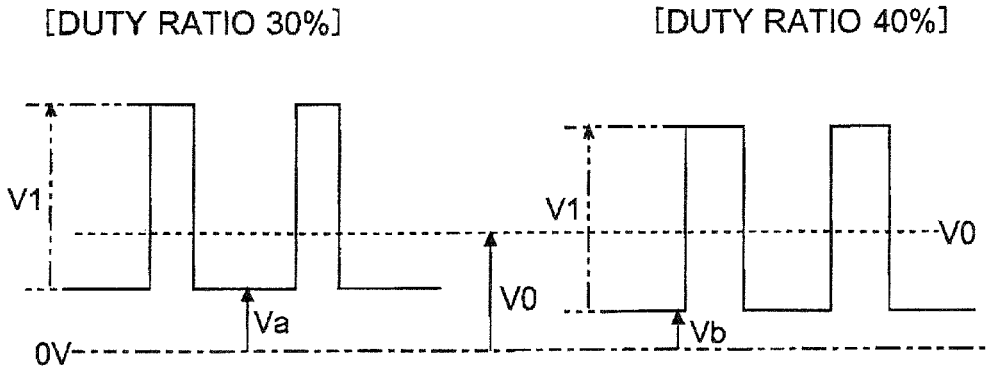
FIG. 8 is a timing chart illustrating an example of a waveform of a control clock signal generated by the control signal generating unit.
Figure 9:
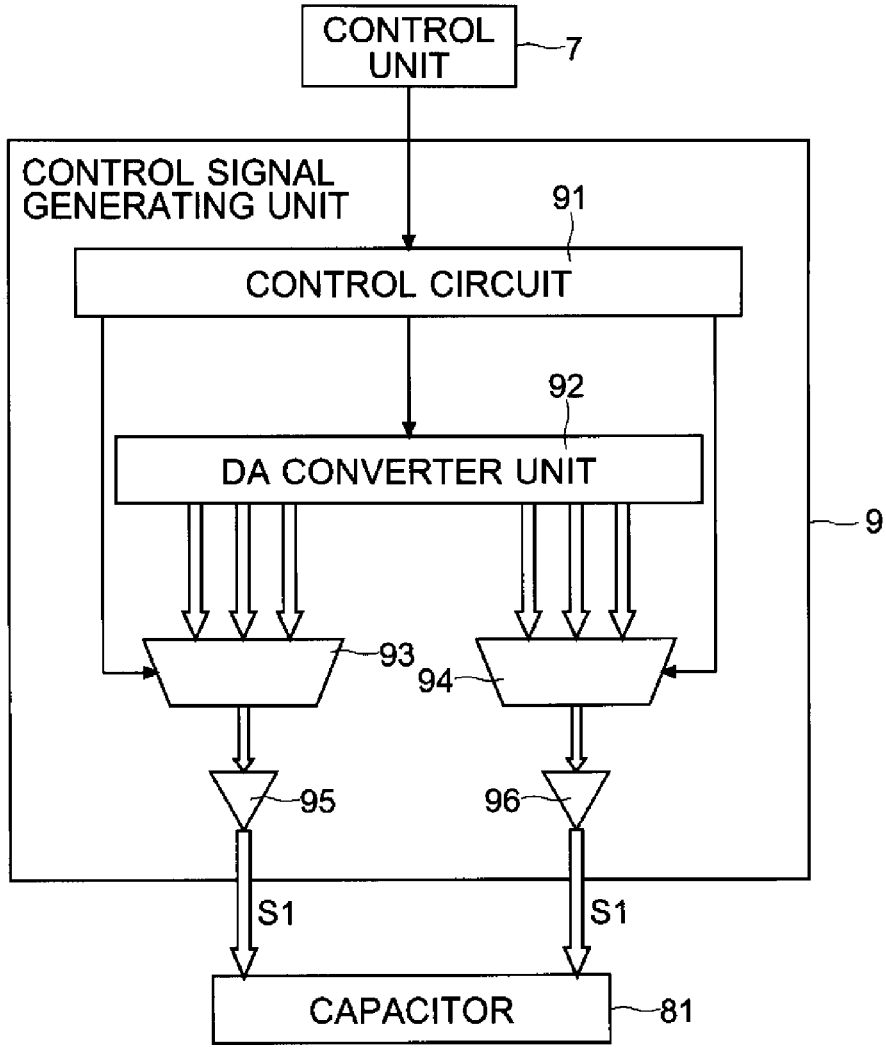
FIG. 9 is a block diagram illustrating an example of a structure of the control signal generating unit.

Next, with reference to FIGS. 7 to 9, there is described an example of generating the control clock signal S1 corresponding to the duty ratio generated by the control signal generating unit 9 of the first embodiment. FIG. 7 is a timing chart for describing a conventional duty ratio change. FIG. 8 is a timing chart illustrating an example of a waveform of the control clock signal S1 generated by the control signal generating unit 9 of the first embodiment. FIG. 9 is a block diagram illustrating an example of a structure of the control signal generating unit 9.

The printer 100 of the first embodiment changes the duty ratio in accordance with the mode. In the printer 100 of the first embodiment, in the developing execution mode, the control signal generating unit 9 sets the duty ratio of the control clock signal S1 and the duty ratio of the voltage applied to the developing roller 11 to approximately 40% (for example, approximately 40±5%). In contrast, in the first mode or the second mode between paper sheets, before executing the developing, or after finishing the developing, the control signal generating unit 9 sets the duty ratio of the control clock signal S1 or the voltage applied to the developing roller 11 to approximately 30% (for example, approximately 30±5%). In this way, there is a difference of the duty ratio between the developing execution mode and the developing inexecution mode. Note that the duty ratio in each mode is not limited to the above-mentioned example. In addition, the duty ratios of the first mode and the second mode are the same in this embodiment, but it is possible to set a difference between them.

Next, with reference to FIG. 7, a duty ratio change of an ordinary conventional clock signal is described.

In FIG. 7, the left side illustrates an example of a waveform of a clock signal having a duty ratio of approximately 30%, and the right side illustrates an example of a waveform of a clock signal having a duty ratio of approximately 40%. In addition, the low state of the clock signal illustrated in the timing chart of FIG. 7 is 0 V (the ground level). In addition, in the timing chart of FIG. 7, the high state of the clock signal is 3 V as an example.

In one period of the clock signal, the area center value V0 is determined so that the product of an absolute value of a difference between the signal value in the high state and the area center value V0 and a high state period is equal to the product of an absolute value of a difference between the signal value in the low state and the area center value V0 and a low state period. The area center value V0 or higher corresponds to the high state, while the area center value V0 or lower corresponds to the low state. Supposing that the duty ratio is approximately 30%, the area center value V0 is approximately 0.9 V when the amplitude is 0 to 3 V. In addition, supposing that the duty ratio is approximately 40%, area center value V0 is approximately 1.2 V. Furthermore, supposing that the duty ratio is 50%, the area center value V0 is 1.5 V that is a half of 3 V. Further, in FIG. 7, a level of the area center value V0 (integral average value) of the clock signal having each duty ratio is illustrated by a broken line.

When the clock signal passes through the capacitor 81, a DC component is removed from the clock signal by the capacitor 81. Further, the area center value V0 (integral average value) in one period of the clock signal after passing through the capacitor 81 becomes zero volts (the ground level).

Here, in the same amplitude of the clock signal, as the duty ratio of the clock signal is larger, a larger DC component is included in the clock signal. Therefore, as illustrated in FIG. 7, the area center value V0 becomes larger as the duty ratio of the clock signal is larger. Therefore, when the duty ratio is changed, energy (charge) stored in the capacitor 81 to which the clock signal is supplied (inputs) is changed, and the capacitor 81 is charged or discharged.

On the other hand, when changing the duty ratio of the voltage (control clock signal S1) applied to the capacitor 81 and the transformer 82, an uneven (lopsided) voltage (having biased energy) is newly applied to the transformer 82 (on the primary side). Then, bias magnetism or magnetic saturation occurs in the transformer 82. When the bias magnetism occurs so that the magnetic flux is biased, there is a state as if the transformer 82 is biased by a DC voltage. Further, when the bias magnetism is increased so that magnetic saturation occurs in the transformer 82, the inductance of the transformer 82 becomes very small. As a result, when the magnetic saturation occurs, a large current flows in a circuit of the developing device 1, and hence a circuit in the developing device 1 (for example, the control signal generating unit 9, the transformer 82 or the capacitor 81) may be broken down with higher possibility. Therefore, it is necessary to prevent the magnetic saturation from occurring in the transformer 82.

Further, it is confirmed that, by suppressing the change of potential of the capacitor 81 due to the duty ratio change, the magnetic saturation in the transformer 82 can be suppressed so that a large current hardly flow in a circuit in the developing device 1. In other words, it is confirmed that a large current hardly flows in the control signal generating unit 9, the capacitor 81 and the transformer 82 when the charge and discharge of the capacitor 81 due to the duty ratio change is suppressed. The mechanism of preventing a large current from flowing in a circuit in the developing device 1 by suppressing the change of potential of the capacitor 81 is not completely elucidated, it is considered that a change of current due to the charge and discharge of the capacitor 81 is eliminated, and further occurrence of the bias magnetism or the magnetic saturation is suppressed.

Therefore, the control signal generating unit 9 adjusts the DC bias value of the control clock signal S1 having each duty ratio so that the DC component of the control clock signal S1 (area center value V0) is the same before and after the duty ratio change.

This point is described with reference to FIG. 8. In FIG. 8, the left side illustrates an example of a waveform of the control clock signal S1 having a duty ratio of approximately 30%. In addition, the right side in FIG. 8 illustrates an example of a waveform of the control clock signal S1 having a duty ratio of approximately 40%. In addition, the control clock signal S1 having each duty ratio illustrated in each timing chart in FIG. 8 has the same amplitude V1 (for example, approximately 3 V). Note that in order to change a peak-to-peak voltage of the AC voltage applied to the developing roller 11 in each mode, it is possible to change the amplitude of the control clock signal S1 before and after the duty ratio change. Even if the amplitude of the control clock signal S1 is changed before and after the duty ratio change, the control signal generating unit 9 generates the control clock signal S1 having the same DC component (area center value V0) before and after the duty ratio change. In addition, FIG. 8 illustrates 0 V (the ground level) by a dashed dotted line.

As illustrated in FIG. 8, the control clock signal S1 having each duty ratio has the same level of the area center value V0 (integral average value). Specifically, first, the control signal generating unit 9 of this embodiment generates the control clock signal S1 biased by the DC voltage and outputs the same. Further, the control signal generating unit 9 adjusts the DC bias value of the control clock signal S1 in accordance with the duty ratio so that the area center value V0 (integral average value) becomes the same. In FIG. 8, Va indicates the DC bias value when the duty ratio is approximately 30%, and Vb indicates the DC bias value when the duty ratio is approximately 40%.

As described above, the area center value V0 (integral average value) becomes larger as the duty ratio becomes larger. Therefore, the control signal generating unit 9 sets the DC bias value of the control clock signal S1 smaller as the duty ratio is larger.

Next, with reference to FIG. 9, an example of a structure of the control signal generating unit 9 is described. For instance, the control signal generating unit 9 includes a control circuit 91, a DA converter unit 92, selectors 93 and 94, and amplifiers 95 and 96 inside. For instance, the control circuit 91 is a substrate or a chip including a CPU and a memory.

In addition, the DA converter unit 92 is a digital-to-analog converter, which outputs a DC voltage according to an instruction of the control circuit 91. The control circuit 91 receives from the control unit 7 an instruction of the duty ratio change due to a change of the mode of the developing device 1 (the developing execution mode, the first mode, and the second mode). The control circuit 91 instructs the DA converter unit 92 about a voltage value (signal value) to be output by a digital signal (for example, a serial signal). The control circuit 91 controls the DA converter unit 92 in advance to generate voltages of a plurality types of signal values including signal values when the control clock signal S1 is the high state and signal values when the same is the low state before and after the change of the duty ratio change in accordance with the change of the mode (FIG. 6 illustrates the example in which the DA converter unit 92 generates and outputs six types of analog voltages).

The plurality types of analog voltages generated by the DA converter unit 92 are supplied to either one of the selectors 93 and 94. FIG. 9 illustrates the example in which two selectors 93 and 94 are disposed, but a single selector or three or more selectors may be disposed. Further, output terminals of the selectors 93 and 94 are connected to amplifiers 95 and 96, respectively. The amplifiers 95 and 96 amplify output signals of the selectors 93 and 94 and output the results to the outside of the control signal generating unit 9. Specifically, the output signals of the amplifiers 95 and 96 are supplied to the capacitor 81 as the control clock signal S1. Because the DA converter unit 92 generates a plurality of signal values in advance, the control circuit 91 can supply the control clock signal S1 of a desired signal value to the capacitor 81 at high speed only by selecting the output by the selectors 93 and 94.

Further, the control circuit 91 controls the DA converter unit 92 to generate the signal value for the high state and the signal value for the low state before the duty ratio change, and the signal value for the high state and the signal value for the low state after the duty ratio change. In this case, the control circuit 91 controls so that the amplitude V1 is the same, and the area center value V0 (integral) of the control clock signal S1 applied to the capacitor 81 in one period is the same, before and after the duty ratio change. Further, the control circuit 91 controls the selectors 93 and 94 before the duty ratio change, so as to control the selectors 93 and 94 to alternately output the signal value of the high state and the signal value of the low state before the duty ratio change, at a timing corresponding to the duty ratio. Further, the control circuit 91 controls the selectors 93 and 94 on the basis of the instruction of the duty ratio change from the control unit 7, so as to control the selectors 93 and 94 to alternately output the signal value of the high state and the signal value of the low state after the duty ratio change, at a timing corresponding to the duty ratio after the change.

Note that the area center value V0 (integral average value) of the control clock signal S1 in one period may be a predetermined fixed value. In this case, the DA converter unit 92 generates a predetermined signal value corresponding to the duty ratio on the basis of the amplitude of the control clock signal S1 in response to the fixed area center value V0. It is supposed that the amplitude of the control clock signal S1 is 1 V and that the area center value V0 is fixed to 1 V. Then, supposing that the duty ratio is 40%, for example, the DA converter unit 92 generates signal values of [area center value V0+0.6=1.6 V] and [area center value V0−0.4 V=0.6 V]. In this case, the control signal generating unit 9 generates the control clock signal S1 that is biased by 0.6 V (on which a DC component is superimposed). In addition, supposing that the duty ratio is 30%, the DA converter unit 92 generates signal values of [area center value V0+0.7=1.7 V] and [area center value V−0.3 V=0.7 V]. In this case, the control signal generating unit 9 generates the control clock signal S1 that is biased by 0.7 V (on which a DC component is superimposed).

(Process Flow of Duty Ratio Change)

Figure 10:
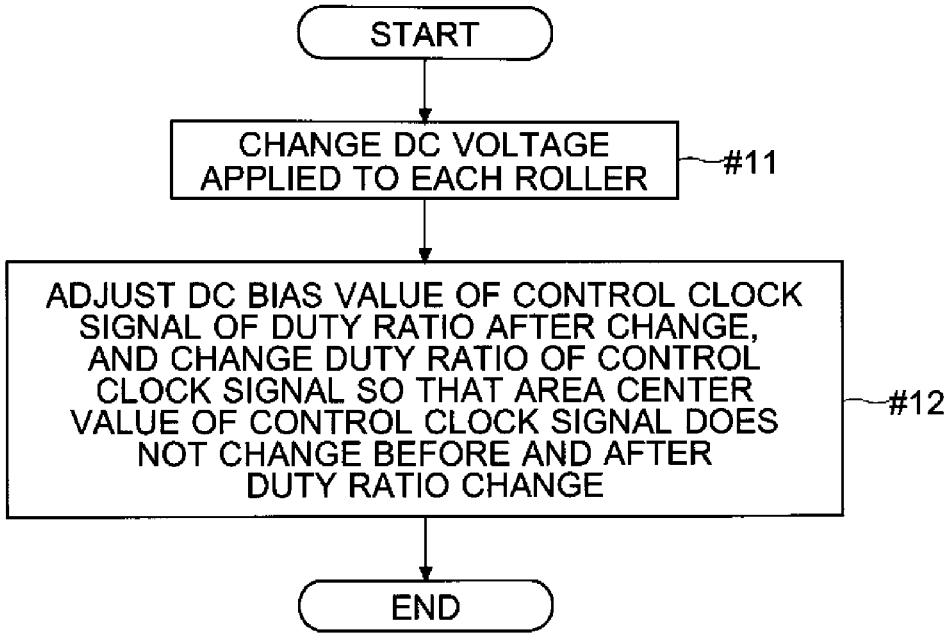
FIG. 10 is a flowchart illustrating an example of a process flow of changing the duty ratio of the control clock signal according to a first embodiment.

Next, with reference to FIG. 10, an example of a flow of the duty ratio change in the developing device 1 of the first embodiment is described. FIG. 10 is a flowchart illustrating an example of a process flow of the duty ratio change of the control clock signal S1 according to the first embodiment. Note that in the developing device 1 of this embodiment, a time when the developing execution mode is changed to the first mode or the second mode or a time when the first mode or the second mode is changed to the developing execution mode corresponds to a time when the duty ratio is changed.

Therefore, the process flow of FIG. 10 starts at a time when the control unit 7 issues an instruction to the control signal generating unit 9, the developing roller bias unit 83, and the magnetic roller bias unit 84, to change from the developing execution mode to the first mode or the second mode, or to change from the first mode or the second mode to the developing execution mode.

When the control unit 7 issues the instruction to change from the developing execution mode to the first mode or the second mode, or to change from the first mode or the second mode to the developing execution mode, the developing roller bias unit 83 changes the DC voltage applied to the developing roller 11, and the magnetic roller bias unit 84 changes the DC voltage applied to the magnetic roller 12 (Step #11). Note that (Step #11) is not necessary when the bias supplied to the developing roller 11 or magnetic roller 12 is not changed.

Next, the control signal generating unit 9 adjusts the DC bias value of the control clock signal S1 for the changed duty ratio, so as to change the duty ratio of the control clock signal S1 so that the area center value V0 of the control clock signal S1 is not changed before and after the duty ratio is changed (Step #12). In this case, the control signal generating unit 9 may output the control clock signal S1 of a predetermined signal value for each duty ratio so that the area center value V0 of the control clock signal S1 is not changed before and after the duty ratio is changed.

Note that the DA converter unit 92 in the control signal generating unit 9 outputs in advance the signal value of the control clock signal S1 after the duty ratio is changed (the signal value of the high state and the signal value of the low state after the duty ratio is changed). Then, the control circuit 91 in the control signal generating unit 9 selects an appropriate signal value by the selectors 93 and 94 and outputs the result to the capacitor 81.

When the duty ratio of the control signal (control clock signal S1) is changed, by keeping the area center value V0 (integral average value, DC component) of the control signal input to the capacitor 81 in one period before and after the duty ratio change, it is possible to suppress an increase of current or magnetic saturation, and hence an extreme increase of current in a circuit such as the transformer 82 included is the developing device 1 can be suppressed. The mechanism thereof is considered as follows although not clearly determined. First, when the duty ratio of the control signal is changed, the DC component of the control signal is changed, and hence the integral average value (area center value V0) of the control signal in one period is changed. Therefore, when the duty ratio of the control signal is changed, the capacitor 81 is charged or discharged in accordance with the change of the DC component. Then, the charge or discharge of the capacitor 81 causes an increase of current flowing on the primary side of the transformer 82, and hence bias magnetism or magnetic saturation is apt to occur in the transformer 82. In such background, in order to prevent the magnetic saturation, increase or decrease of the DC component applied to the capacitor 81 should be eliminated.

Therefore, the developing device 1 according to this embodiment includes the developing roller 11, the magnetic roller 12, the capacitor 81, the transformer 82, and the control signal generating unit 9. Further, the developing roller 11 is opposed to the photosensitive drum 42 and carries toner. The magnetic roller 12 is disposed to be opposed to the developing roller 11 and perform supply of toner to the developing roller 11 and removal of toner from the developing roller 11 by the magnetic brush. The transformer 82 is connected to the capacitor 81 on the primary side and outputs the AC voltage from the secondary side so as to apply the AC voltage to the developing roller 11. The control signal generating unit 9 generates a control signal (control clock signal S1) to be input to the capacitor 81, and adjusts the DC bias value of the control signal in accordance with the duty ratio change, so that the DC component of the control signal is the same before and after the change of the duty ratio of the control signal when the duty ratio of the control signal is changed.

Thus, the DC component of the voltage applied to the capacitor 81 can be kept same (constant) before and after the duty ratio change of the control signal (control clock signal S1) so that magnetic saturation hardly occurs. Therefore, even if the duty ratio of the control signal is changed, it is possible to prevent a large current from flowing in a circuit included in the developing device 1. Thus, it is possible to prevent the circuit (for example, the transformer 82 or the capacitor 81) in the developing device 1 from being broken down. Further, in order to set an appropriate duty ratio for preventing occurrence of unevenness in the toner image or to set a duty ratio such that a leakage does not occur between the developing roller 11 and the photosensitive drum 42, it is possible to change the duty ratio arbitrarily without a problem. Therefore, it is possible to provide the developing device 1 having high image quality without a leakage in which occurrence of unevenness in the toner image can be suppressed.

In addition, there is a case where unevenness in the toner image can be eliminated more appropriately by a relatively larger duty ratio during printing. On the other hand, there is a case where a leakage occurs more hardly by a relatively smaller duty ratio because of exposure of the surface of the developing roller 11 due to removal of the toner in a non-printing state. Therefore, the control signal generating unit 9 sets the duty ratio of the control signal (control clock signal S1) in the developing execution mode for developing the electrostatic latent image formed on the photosensitive drum 42 different from the duty ratio of the control signal in the developing unexecuted mode in which the electrostatic latent image formed on the photosensitive drum 42 is not developed. Further, the duty ratio in the developing execution mode is larger than the duty ratio in the developing unexecuted mode.

Thus, it is possible that the leakage hardly occur while unevenness in the toner image is appropriately eliminated. Further, it is possible to quickly change the duty ratio between the developing execution mode and the developing unexecuted mode. Therefore, it is not necessary to intentionally increase an interval between paper sheets or to stop printing for changing the duty ratio, unlike the conventional structure. It is possible to provide the developing device 1 that can perform high speed developing process without decreasing speed of the developing process.

In addition, the control signal generating unit 9 generates the clock signal (control clock signal S1) as the control signal. Further, the control signal generating unit 9 adjusts the DC bias value of the clock signal so that the DC component is the same before and after the change of the duty ratio of the clock signal. Thus, even if the duty ratio is changed by a clock signal having rapidly changing signal values (rectangular wave), it is possible to securely prevent occurrence of magnetic saturation.

In addition, the developing device 1 includes the DA converter unit 92 for generating the signal value for the high state and the signal value for the low state before the duty ratio change, and the signal value for the high state and the signal value for the low state after the duty ratio change. Further, the control signal generating unit 9 selects the signal value generated by the DA converter unit 92. In addition, the control signal generating unit 9 changes the duty ratio of the control signal so that the DC component of the control signal is the same before and after the duty ratio change of the control signal (control clock signal S1). In other words, the control signal generating unit 9 changes the duty ratio of the control signal so that the area center value V0 in one period of the control clock signal S1 applied to the capacitor 81 is the same. Thus, the signal value used for the control signal of the duty ratio after the change is generated in advance before the change of the duty ratio of the control signal. Therefore, the duty ratio of tire control signal can be promptly changed. In addition, magnetic saturation is not generated even if the duty ratio is promptly changed.

In addition, as described above, the area center value V0 (integral average value) becomes larger as the duty ratio of the control signal (control clock signal S1) becomes larger. Therefore, the control signal generating unit 9 sets the DC bias value of the control signal smaller as the duty ratio of the control signal (control clock signal S1) is larger, and set the DC bias value of the control signal larger as the duty ratio of the control signal is smaller. Thus, the duty ratio of the control signal can be changed so that the DC component of the control signal is the same before and after the change of the duty ratio.

In addition, the image forming apparatus (printer 100) includes the developing device 1 according to the embodiment. Thus, the image forming apparatus includes the developing device 1 in which magnetic saturation does not occur so that a circuit is not broken down even if the duty ratio of the control signal (control clock signal S1) is changed. Therefore, it is possible to provide the image forming apparatus in which a breakdown or a problem does not occur in the developing device 1. In addition, in the developing device 1, it is possible to set an appropriate duty ratio for preventing occurrence of unevenness in the toner image, and to set a duty ratio such that no leakage occurs between the developing roller 11 and the photosensitive drum 42. Therefore, it is possible to provide the image forming apparatus having high image quality without a leakage in which occurrence of unevenness in the toner image can be suppressed.

Second embodiment

Figure 11:
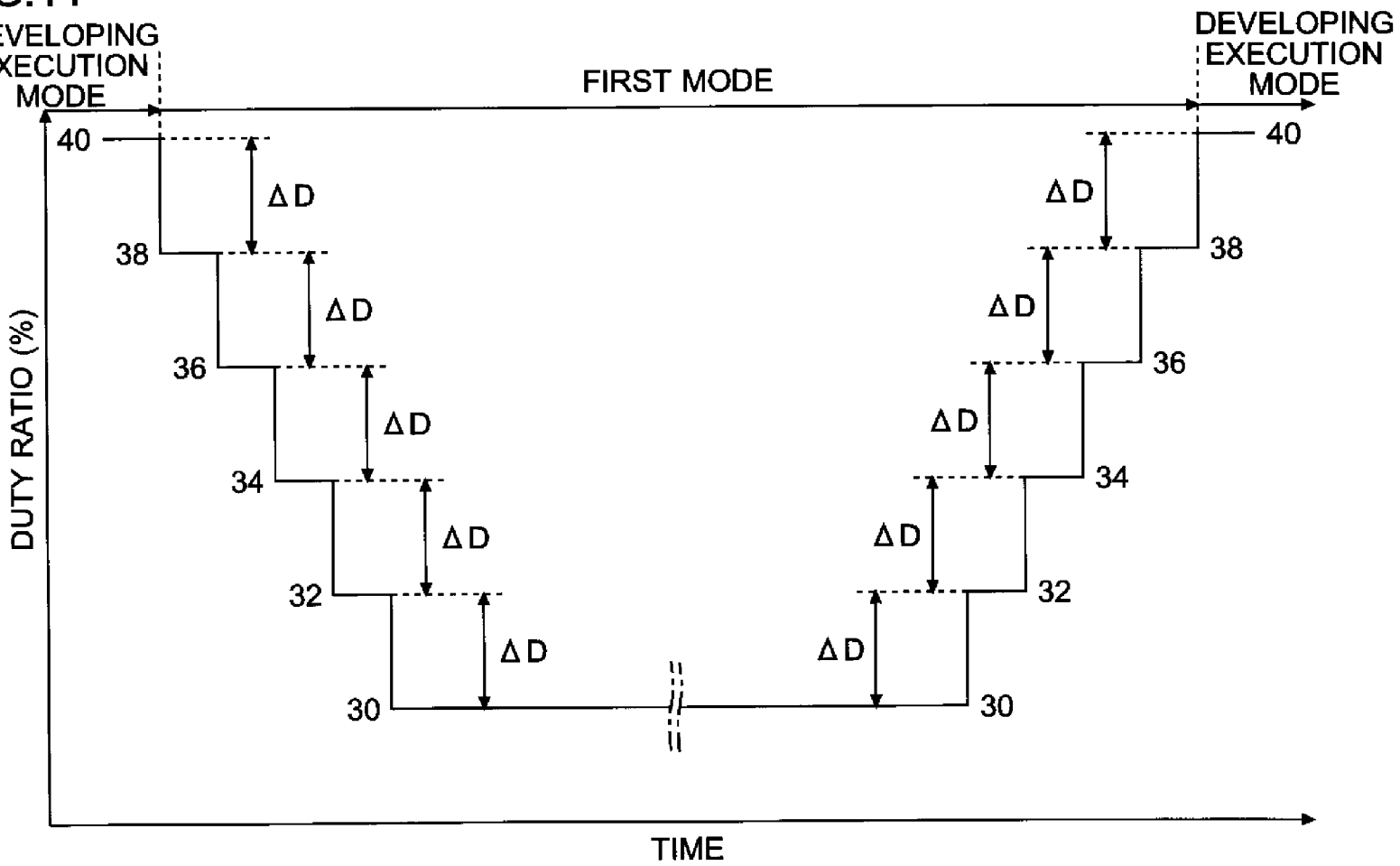
FIG. 11 is an explanatory diagram illustrating an outline of a step-like change of the duty ratio according to a second embodiment.
Figure 12:
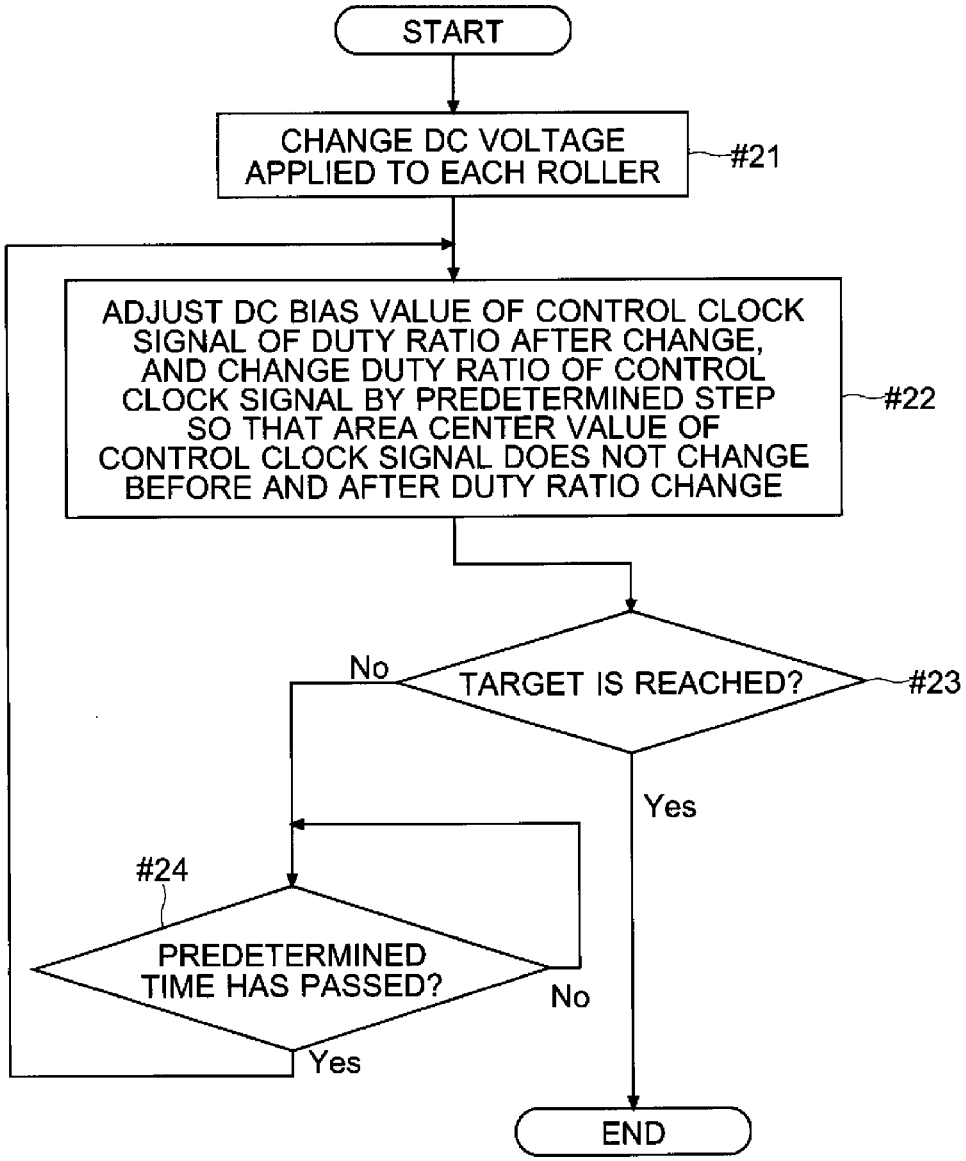
FIG. 12 is a flowchart illustrating an example of a process flow when the duty ratio of the control clock signal is changed according to the second embodiment.

Next, with reference to FIGS. 11 and 12, a second embodiment is described. FIG. 11 is an explanatory diagram illustrating an outline of a step-like change of the duty ratio according to the second embodiment. FIG. 12 is a flowchart illustrating an example of a process flow when the duty ratio of the control clock signal S1 is changed according to the second embodiment.

As described above, when the duty ratio is changed, bias magnetism occurs in the transformer 82 so that a large current is apt to flow in the developing device 1 (for example, in the transformer 82 or the capacitor 81). In particular, a larger bias magnetism is apt to occur in the transformer 82 as a transient duty ratio change is larger.

On the other hand, even if bias magnetism occurs in the transformer 82, because of resonance of the capacitor 81 and the transformer 82, the potential between the capacitor 81 and the transformer 82 is oscillated while the bias magnetism is reduced along with passage of time. Therefore, bias magnetism of the transformer 82 has a tendency of being reduced along with passage of time.

Therefore, in the developing device 1 of the second embodiment, the control signal generating unit 9 changes the duty ratio of the clock signal (voltage applied to the capacitor 81) step by step so as to suppress the duty ratio change for one time while the duty ratio is changed to a target value. Thus, it is possible to change the duty ratio while preventing a large current from flowing in a circuit of the developing device 1 as much as possible.

Note that the point of changing the duty ratio of the clock signal (voltage applied to the capacitor 81) step by step is different from the first embodiment, but other points may be the same as the first embodiment. For instance, the DC bias value of the control clock signal S1 is adjusted so that the area center value V0 of the control clock signal S1 (integral average value) is not changed before and after the change of the duty ratio in the same manner as in the first embodiment. Therefore, concerning the same part between the first embodiment and the second embodiment, the description of the first embodiment is used, and overlapping description and illustration are omitted unless otherwise noted.

Therefore, with reference to FIG. 11, an example of the duty ratio change in the second embodiment is described. The example of FIG. 11 shows an example of the duty ratio change when the mode is changed from the developing execution mode to the first mode between paper sheets and further to the developing execution mode, in successive printing on paper sheets. Note that FIG. 11 illustrates the duty ratio of the control clock signal S1 in the developing execution mode as approximately 40%. In addition, FIG. 11 illustrates the duty ratio of the control clock signal S1 in the first mode as approximately 30%.

As illustrated in FIG. 11, when the duty ratio of the clock signal is changed along with the change from the developing execution mode to the first mode, the control signal generating unit 9 changes the duty ratio by a step (increment or decrement) such that magnetic saturation does not occur in the transformer 82. In FIG. 11, an example of the step is denoted by ΔD. In addition, also when the duty ratio of the control clock signal S1 in the first mode is changed back to the duty ratio of the control clock signal S1 in the developing execution mode, the control signal generating unit 9 changes the duty ratio by the step (ΔD) that does not cause magnetic saturation in the transformer 82. For instance, in the example of FIG. 11, the step of the duty ratio is 2%. This step can be determined in advance by experiment or the like as a value such that magnetic saturation does not occur in the transformer 82.

As illustrated in FIG. 11, supposing that a width of the duty ratio of the control clock signal S1 to be changed is 10% and that the step is 2%, the control signal generating unit 9 changes the duty ratio to a target value by five steps (changes five times). The steps may be six or more steps, or two to four steps. As the number of steps is larger, magnetic saturation occurs more hardly in the transformer 82. Therefore, it is preferred to adopt five or more steps.

The control signal generating unit 9 changes the duty ratio step by step at an interval of approximately a few milliseconds to 10 milliseconds. In the printer 100 of this embodiment, the interval between paper sheets is set to approximately 200 milliseconds to 300 milliseconds. Therefore, there is sufficient time margin in the interval between paper sheets for changing the duty ratio step by step to the target duty ratio.

(Process Flow for Changing Duty Ratio Step by Step)

Next with reference to FIG. 12, there is described an example of a process flow for changing the duty ratio of the control clock signal S1 step by step in the second embodiment. FIG. 12 is a flowchart of an example of the process flow for changing the duty ratio of the clock signal step by step in the second embodiment. Note that in this embodiment too, a time when the developing execution mode is changed to the first mode or the second mode or a time when the first mode or the second mode is changed to the developing execution mode corresponds to a time when the duty ratio is changed.

Therefore, the process flow of FIG. 12 starts at a time when the control unit 7 issues an instruction to the control signal generating unit 9, the developing roller bias unit 83, and the magnetic roller bias unit 84, to change from the developing execution mode to the first mode or the second mode, or to change from the first mode or the second mode to the developing execution mode.

When the instruction is issued to change from the developing execution mode to the first mode or the second mode, or to change from the first mode or the second mode to the developing execution mode, the developing roller bias unit 83 changes the DC voltage applied to the developing roller 11, and the magnetic roller bias unit 84 changes the DC voltage applied to the magnetic roller 12 (Step #21). Note that Step #21 is not necessary when the bias applied to the developing roller 11 or the magnetic roller 12 is not changed.

Next, the control signal generating unit 9 adjusts the DC bias value of the control clock signal S1 of the duty ratio after the change so that the area center value V0 of the control clock signal S1 is not changed before and after the duty ratio is changed, and hence changes the duty ratio of the control clock signal S1 by a predetermined step (Step #22). Note that when the developing execution mode is changed to the first mode or the second mode, the duty ratio of the clock signal is decreased. In addition, when the first mode or the second mode is changed to the developing execution mode, the duty ratio of the clock signal is increased. The step of the duty ratio may be changed.

Further, the control signal generating unit 9 checks whether or not the duty ratio has reached the target duty ratio (Step #23). The duty ratio of the control clock signal S1 in the developing execution mode (approximately 40%) or the duty ratio of the control clock signal S1 in the first mode (approximately 30%) is the target duty ratio.

If the duty ratio has reached the target duty ratio (Yes in Step #23), this flow is finished (END). Further, the control signal generating unit 9 and the control circuit 91 maintains the duty ratio until receiving the instruction from the control unit 7 to change mode or to apply no signal.

On the other hand, if the duty ratio has not reached the target duty ratio (No in Step #23), the control signal generating unit 9 continues to check whether or not a predetermined time has passed after the duty ratio is changed before (Step #24, No in Step #24 to Step #24). The control circuit 91 of the control signal generating unit 9 includes a timer inside and has a clock function. Then, the control circuit 91 checks whether or not the time point for changing the duty ratio by the step next after the duty ratio is changed before is reached (Step #24). The predetermined time is set to a time or longer such that magnetic saturation does not occur even if the duty ratio is changed next by the step after the duty ratio is changed before. If the predetermined time passes from the time point when the duty ratio is changed before (Yes in Step #24), the flow goes back to Step #23.

In this way, when the control signal generating unit 9 of this embodiment changes the duty ratio from the first duty ratio to the second duty ratio, it uses the step such that magnetic saturation does not occur in the transformer 82 so as to secure the predetermined time while it changes the duty ratio a plurality of times step by step from the first duty ratio to the second duty ratio. Thus, the duty ratio can be changed so that magnetic saturation does not occur securely in the transformer 82. In addition, because the next step-like change of the duty ratio is performed after at least a predetermined time has passed from the duty ratio is changed, a time period for reducing the bias magnetism generated by the duty ratio change is secured. Therefore, it is possible to prevent a large current from flowing in the developing device 1 due to the duty ratio change, and to prevent a circuit in the developing device 1 from being broken down.

Here, the mode before being changed is referred to as a "first duty ratio." The target duty ratio (the duty ratio in the mode after being changed) is referred to as a "second duty ratio." In the change in the duty ratio from the developing execution mode to the first mode, the first duty ratio is 40%, and the second duty ratio is 30%. In the change in the duty ratio when the first mode is returned to the developing execution mode, the first duty ratio is 30%, and the second duty ratio is 40%.

In addition, the control signal generating unit 9 changes the first duty ratio to the second duty ratio (target duty ratio) by five or more steps. Thus, the target duty ratio can be reached by many steps. Therefore, using many steps, it is possible that magnetic saturation hardly occur in the transformer 82.

In the first and second embodiments, the photosensitive drum 42 and the toner that are positively charged are exemplified, but the content disclosed in this description can be also applied to the case where the photosensitive drum 42 and the toner that are negatively charged are used. In this case, in the state where the developing process is performed for the negative charge (developing execution mode), the duty ratio should be determined so that unevenness is reduced. In addition, in the state where the developing process is not performed (developing inexecution mode), the duty ratio should be determined so that leakage does not occur.

The contents disclosed in the first and second embodiments can also be grasped as a method for controlling the developing device.

The embodiments of the present disclosure are described above, but the scope of the present disclosure is not limited to the embodiments, which can be variously modified without deviating from the scope of the spirit of the disclosure.

What is claimed is:

1. A developing device comprising:

a developing roller which is opposed to a photosensitive drum and carries toner;

a magnetic roller which is disposed to be opposed to the developing roller and performs supply of toner to the developing roller and removal of toner from the developing roller using a magnetic brush;

a capacitor;

a transformer to a primary side of which the capacitor is connected and from a secondary side of which an AC voltage to be applied to the developing roller is output; and a control signal generating unit which generates a control signal to be input to the capacitor, and adjusts a DC bias value of the control signal, when changing a duty ration of the control signal, in accordance with the duty ration change so that a DC component of the control signal is the same before and after the change of the duty ratio of the control signal.

2. The developing device according to claim 1, wherein the control signal generating unit sets different duty ratio of the control signal between a developing execution mode in which an electrostatic latent image formed on the photosensitive drum is developed and a developing unexecuted mode in which the electrostatic latent image formed on the photosensitive drum is not developed, and the duty ratio of the control signal in the developing execution mode is larger than the duty ration in the developing unexecuted mode.

3. The developing device according to claim 1, wherein the control signal generating unit generates a clock signal as the control signal and adjusts a DC bias value of the clock signal so that the DC component is the same before and after the change of the duty ratio of the clock signal.

4. The developing device according to claim 1, further comprising a DA converter unit which generates a signal value for high state and a signal value for low state before the duty ration change, and the signal value for the high state and the signal value for the low state after the duty ratio change, wherein the control signal generating unit selects a signal value generated by the DA converter unit and changes the duty ratio of the control signal so that the DC component of the control signal is the same before and after the change of the duty ratio of the control signal.

5. The developing device according to claim 1, wherein the control signal generating unit sets the DC bias value of the control signal smaller as the duty ratio of the control signal is larger, and sets the DC bias value of the control signal larger as the duty ratio of the control signal is smaller.

6. The developing device according to claim 1, wherein the control signal generating unit changes the duty ratio a plurality of times step by step from a first duty ratio to a second duty ratio by a step such that magnetic saturation does not occur in the transformer while securing a predetermined time when changing the duty ratio from the first duty ratio to the second duty ratio.

7. The developing device according to claim 6, wherein the control signal generating unit changes from the first duty ratio to the second duty ratio in five or more steps.

8. An image forming apparatus comprising the developing device according to claim 1.

9. A method for controlling a developing device, the method comprising the steps of:

permitting a developing roller opposed to a photosensitive drum to carry toner;

disposing a magnetic roller opposed to the developing roller so that the magnetic brush performs supply of the toner to the developing roller and removal of the toner from the magnetic roller;

connecting a capacitor to a primary side of the transformer;

permitting a secondary side of the transformer to output an AC voltage to be applied to the developing roller;

generating a control signal to be input to the capacitor; and changing a duty ratio of the control signal and adjusting a DC bias value of the control signal in accordance with the duty ratio change so that a DC component of the control signal is the same before and after the change of the duty ratio of the control signal.

10. The method for controlling a developing device according to claim 9, wherein a duty ratio of the control signal in a developing execution mode in which an electrostatic latent image formed on the photosensitive drum is developed is different from a duty ration of the control signal in a developing unexecuted mode in which the electrostatic latent image formed on the photosensitive drum is not developed, and the duty ratio of the control signal in the developing execution mode is larger than the duty ration in the developing unexecuted mode.

11. The method for controlling a developing device according to claim 9, wherein a clock signal is generated as a control signal, and a DC bias value of the clock signal is adjusted so that the DC component is the same before and after the change of the duty ration of the clock signal.

12. The method for controlling a developing device according to claim 9, further comprising:

generating a signal value for high state and a signal value for low state before the duty ration change, and the signal value for the high state and the signal value for the low state after the duty ratio change; and selecting a generated signal value and changing the duty ratio of the control signal so that the DC component of the control signal is the same before and after the change of the duty ratio of the control signal.

13. The method for controlling a developing device according to claim 9, further comprising:

setting the DC bias value of the control signal smaller as the duty ratio of the control signal is larger; and setting the DC bias value of the control signal larger as the duty ratio of the control signal is smaller.

14. The method for controlling a developing device according to claim 9, further comprising changing the duty ratio a plurality of times step by step from a first duty ratio to the securing a predetermined time when changing the duty ratio from the first duty ration to a second duty ratio.

15. The method for controlling a developing device according to claim 14, further comprising changing from the first duty ratio to the second duty ration in five or more steps.

* * * * *